US006756191B2

(12) United States Patent
Tanaka et al.

(10) Patent No.: US 6,756,191 B2
(45) Date of Patent: Jun. 29, 2004

(54) SILVER HALIDE PHOTOGRAPHIC LIGHT-SENSITIVE EMULSION AND SILVER HALIDE PHOTOGRAPHIC LIGHT-SENSITIVE MATERIAL USING THEREOF

(75) Inventors: Tatsuo Tanaka, Sagamihara (JP); Nobuaki Kagawa, Iruma (JP); Yoshiko Iwai, Sagamihara (JP); Tomohiro Oshiyama, Hachioji (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/199,166

(22) Filed: Jul. 19, 2002

(65) Prior Publication Data

US 2003/0157447 A1 Aug. 21, 2003

(30) Foreign Application Priority Data

Aug. 7, 2001 (JP) ..... 2001-239128

(51) Int. Cl.[7] ..... G03C 1/08

(52) U.S. Cl. ..... 430/600; 430/570; 430/576; 430/577; 430/603

(58) Field of Search ..... 430/570, 576, 430/577, 600, 603

(56) References Cited

U.S. PATENT DOCUMENTS

| | | | | |
|---|---|---|---|---|
| 3,419,393 A | | 12/1968 | Thompson et al. | |
| 4,987,064 A | * | 1/1991 | Saitou et al. | 430/570 |
| 5,393,655 A | * | 2/1995 | Sasaki et al. | 430/603 |
| 5,716,773 A | * | 2/1998 | Nairne et al. | 430/565 |
| 5,922,527 A | * | 7/1999 | Barlow et al. | 430/611 |
| 5,952,166 A | * | 9/1999 | Lok et al. | 430/567 |

FOREIGN PATENT DOCUMENTS

| | | |
|---|---|---|
| BE | 677013 | 2/1966 |
| EP | 0 566 074 | 10/1993 |
| EP | 0 750 223 | 12/1996 |
| FR | 2.007.060 | 1/1970 |
| JP | 7-159916 | 6/1995 |
| JP | 9-138478 | 5/1997 |
| JP | 2001-235825 | 8/2001 |
| JP | 2002-72396 | 3/2002 |
| WO | WO 98/02779 | 1/1998 |

* cited by examiner

*Primary Examiner*—Thorl Chea
(74) *Attorney, Agent, or Firm*—Squire, Sanders & Dempsey

(57) ABSTRACT

A silver halide photographic light-sensitive emulsion comprising a silver halide and a compound represented by the following Formula (I):

Formula (I)

wherein each $X^3$ and $X^4$ represents independently N, P, S, Se or Te; each $Y^1$ and $Y^2$ represents independently a group of carbon atoms necessary to complete a 6 to 12 membered heterocyclic ring with $X^3$ and $X^4$.

6 Claims, No Drawings

SILVER HALIDE PHOTOGRAPHIC LIGHT-SENSITIVE EMULSION AND SILVER HALIDE PHOTOGRAPHIC LIGHT-SENSITIVE MATERIAL USING THEREOF

FIELD OF THE INVENTION

The invention relates to a silver halide photographic light-sensitive emulsion and also to a silver halide photographic light-sensitive material (hereafter also simply referred to a light-sensitive material) produced by the use of the emulsion having high light-sensitivity and excellent storage stability.

BACKGROUND OF THE INVENTION

A great deal of efforts has been made to increase the light-sensitivity or photographic speed of silver halide photographic light-sensitive materials. Particularly, it is strongly demanded to make higher the light-sensitivity of spectrally sensitized silver halide photographic light-sensitive materials. The spectral sensitization is an extremely important and essential technology for producing a light-sensitive material having high light sensitivity and high color reproducibility. A spectral sensitizer has a function of absorbing light of longer wavelength that is substantially not absorbed by silver halide photographic light-sensitive emulsion and transmitting the energy of the absorbed light to the silver halide. Therefore, the increasing of the supplemental amount of light by the spectral sensitizer is advantageous for raising the photographic sensitivity of the emulsion. Consequently, it has been tried to increase the supplemental amount of light by increasing the adding amount of the spectral sensitizer to the silver halide photographic light-sensitive emulsion. However, when the adding amount of the spectral sensitizer exceeds the optimum amount, it tends to cause serious desensitization. Such phenomenon, so called dye desensitization, is an occurrence of the desensitization in an inherent light sensitive region of a silver halide where the light is substantially not absorbed by the spectral sensitizer. When the dye desensitization is large, the resulting sensitivity is lowered even though the spectral sensitization is occurred. In other words, the spectral sensitization would be increased when the desensitization accompanied by a spectral sensitizer is reduced. Accordingly, the improvement of the dye sensitization is an important theme in the technology of the spectral sensitization.

It has been known that a sensitizing dye having a reducing potential of not less than −1.25 V has a low relative quantum yield, as described in *T. Tani*, "Journal of Physical Chemistry", 94, p. 1298, 1990. For increasing the relative quantum yield of the spectral sensitization by the dye, the supersensitization by positive hole trapping is proposed in "The Theory of the Photographic Process", p.p. 259–265, 1966.

A compound having an oxidation potential more negative than that of the spectral sensitizing dye is used together with the sensitizing dye in order to resolve the problem of the foregoing desensitization. Examples of such compound include those described in U.S. Pat. Nos. 2,313,922, 2,075,046, 2,448,858 and 2,680,686, British Patent No. 1,230,449 and Belgian Patent No. 771,168.

Sensitizing techniques using an organic electron donating compound constituted by an electron donating group and a leaving group are described in U.S. Patent Nos. 5,747,235 and 5,747,236, European Patent Nos. 786,692, 892,731 and 892,732 and International Patent Publication WO99/05570.

However, a means for obtaining further high sensitivity is required since the sensitivity raising effect of such compound is insufficient and the fogging tends to be occurred.

An object of the present invention is to provide a silver halide photographic light-sensitive emulsion and a silver halide photographic light-sensitive material having high sensitivity and excellent storage stability.

SUMMARY OF THE INVENTION

The object of the invention can be achieved by the following embodiments.

1. A silver halide photographic light-sensitive emulsion comprising a silver halide and a compound represented by the following Formula (I):

Formula (I)

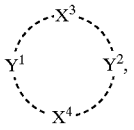

wherein each $X^3$ and $X^4$ represents independently N, P, S, Se or Te; each $Y^1$ and $Y^2$ represents independently a group of carbon atoms necessary to complete a 6 to 12 membered heterocyclic ring with $X^3$ and $X^4$.

2. The silver halide photographic light-sensitive emulsion of item 1, wherein $X^3$ and $X^4$ each represent S.
3. The silver halide photographic light-sensitive emulsion of item 1, wherein each $Y^1$ and $Y^2$ represents independently a group of carbon atoms necessary to complete a 8 to 10 membered heterocyclic ring with $X^3$ and $X^4$.

4. A silver halide photographic light-sensitive emulsion comprising a silver halide and a compound represented by the following Formula (II):

$$(Z)_{k1}[(L)_{k3}X]_{k2} \qquad \text{Formula (II),}$$

wherein Z represents an organic group capable of adsorbing to the silver halide or an organic group capable of absorbing light; L is a linking group; X is a group having a moiety represented by Formula (I):

Formula (I)

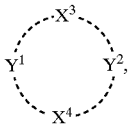

wherein each $X^3$ and $X^4$ represents independently N, P, S, Se or Te; each $Y^1$ and $Y^2$ represents independently a group of carbon atoms necessary to complete a 6 to 12 membered heterocyclic ring with $X^3$ and $X^4$; k1 represents an integer of 0 to 4; k2 represents an integer of 1 to 4; and k3 represents an integer of 0 or 1.

5. The silver halide photographic light-sensitive emulsion of item 4, wherein $X^3$ and $X^4$ each represent S.
6. The silver halide photographic light-sensitive emulsion of item 1, wherein the silver halide emulsion further comprises a spectral sensitizing dye.

7. The silver halide photographic light-sensitive emulsion of item 3, wherein the silver halide emulsion further comprises a spectral sensitizing dye.

8. The silver halide photographic light-sensitive emulsion of item 4, wherein the silver halide emulsion further comprises a spectral sensitizing dye.

9. The silver halide photographic light-sensitive emulsion of item 6, wherein the spectral sensitizing dye is a cyanine dye or a merocyanine dye.

10. The silver halide photographic light-sensitive emulsion of item 7, wherein the spectral sensitizing dye is a cyanine dye or a merocyanine dye.

11. The silver halide photographic light-sensitive emulsion of item 8, wherein the spectral sensitizing dye is a cyanine dye or a merocyanine dye.

12. A silver halide photographic light-sensitive material comprising a support having thereon a photosensitive layer comprising the photosensitive silver halide emulsion of item 1.

13. A silver halide photographic light-sensitive material comprising a support having thereon a photosensitive layer comprising the photosensitive silver halide emulsion of item 3.

14. A silver halide photographic light-sensitive material comprising a support having thereon a photosensitive layer comprising the photosensitive silver halide emulsion of item 4.

DETAILED DESCRIPTION OF THE INVENTION

A cyanine dye, a merocyanine dye, a rhodacyanine dye, a tri nucleus merocyanine dye, an allopolar dye, a hemicyanine dye and a styryl dye are preferably usable as the sensitizing dye in the invention. These dyes are described in detail in, for example, F. M. Harmer, "Heterocyclic Compounds—Cyanine Dyes and Related Compounds", John Wiley & Sons, New York, London, 1964, D. M. Sturmer, "Heterocyclic Compounds—Special topics in heterocyclic chemistry", Sec. 18, Item 14, p.p. 482–515.

The cyanine dyes, merocyanine dyes, and rhodacyanine dyes described in U.S. Pat. No. 5,340,694, P.P. 21–22, (XI), (XII) and (XIII) are preferred.

A compound selected from the group represented by the following Formulas 4 through 8 is more preferably used as the sensitizing dye to be used in the invention.

Formula 4

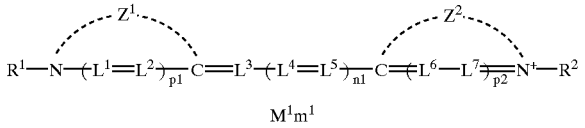

Formula 5

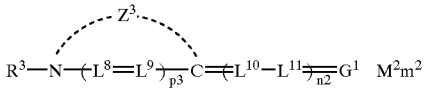

In Formula 4, $L^1$, $L^2$, $L^3$, $L^4$, $L^5$, $L^6$ and $L^7$ are each a methine group; p1 and p2 are each an integer of 0 or 1; n is an integer of 0, 1, 2 or 3; $Z^1$ and $Z^2$ are each a group of atoms necessary to complete a 5- or 6-membered nitrogen-containing heterocyclic ring; $M^1$ is a counter ion; ml is an integer of 0, 1, 2, 3 or 4 necessary for neutralizing the charge of the molecule; and $R^1$ and $R^2$ are each an alkyl group, an aryl group or a heterocyclic group.

In Formula 5, $L^8$, $L^9$, $L^{10}$ and $L^{11}$ are each a methine group; p3 is an integer of 0 or 1; n2 is an integer of 0, 1, 2 or 3; $Z^3$ is a group of atoms necessary to complete a 5- or 6-membered nitrogen-containing heterocyclic ring; $R^3$ is an alkyl group, an aryl group or a heterocyclic group; $M^2$ is a counter ion; $m^2$ is an integer of 0, 1, 2, 3 or 4 necessary for neutralizing the charge of the molecule; and G is a group represented by the following.

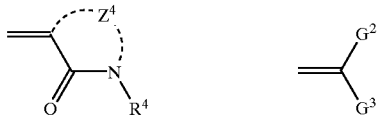

In the above-mentioned, $Z^4$ is a group of atoms necessary to complete a 5- or 6-membered nitrogen-containing heterocyclic ring; $R^4$ is an alkyl group, an aryl group or a heterocyclic group; $G^2$ and $G^3$ are each a cyano group, an ester group, an acyl group, a carbamoyl group, an alkylsulfonyl group, an arylsulfonyl group, a sulfinyl group or a sulfamoyl group.

Formula 6

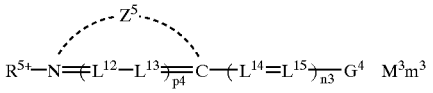

Formula 7

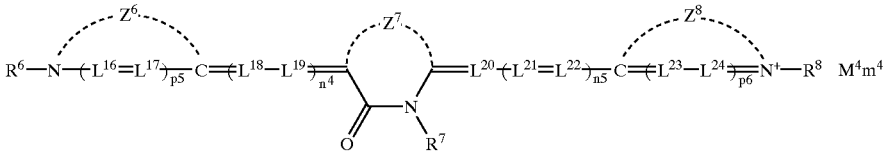

Formula 8

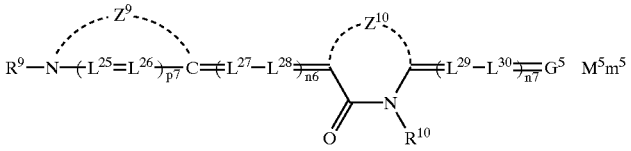

In Formula 6, $L^{12}$ $L^{13}$ $L^{14}$ and $L^{15}$ are each a methine group; p4 is an integer of 0 or 1; n3 is an integer of 0, 1, 2 or 3; $Z^5$ is a group of atoms necessary to complete a 5- or 6-membered nitrogen-containing heterocyclic ring; $R^5$ is an alkyl group, an aryl group or a heterocyclic group; $M^3$ is a counter ion; $m^3$ is an integer of 0, 1, 2, 3 or 4 necessary for neutralizing the charge of the molecule; and $G^4$ is a substituted or unsubstituted amino group, or a substituted or unsubstituted aryl group.

In Formula 7, $L^{16}$, $L^{17}$, $L^{18}$, $L^{19}$, $L^{20}$, $L^{21}$, $L^{22}$, $L^{23}$ and $L^{24}$ are each a methine group; p5 and p6 are each an integer of 0 or 1; n4 is an integer of 0, 1, 2 or 3; $Z^6$, $Z^7$ and $Z^8$ are each a group of atoms necessary to complete a 5- or 6-membered nitrogen-containing heterocyclic ring; $M^4$ is a counter ion; $m^4$ is an integer of 0, 1, 2, 3 or 4 necessary for neutralizing the charge of the molecule; and $R^6$, $R^7$ and $R^8$ are each an alkyl group, an aryl group or a heterocyclic group.

In Formula 8, $L^{25}$, $L^{26}$, $L^{27}$, $L^{28}$, $L^{29}$ and $L^{30}$ are each a methine group; p7 is an integer of 0 or 1; n6 and n7 are each an integer of 0, 1, 2 or 3; $Z^9$ and $Z^{10}$ are each a group of atoms necessary to complete a 5- or 6-membered nitrogen-containing heterocyclic ring; $M^5$ is a counter ion; $m^5$ is an integer of 0, 1, 2, 3 or 4 necessary for neutralizing the charge of the molecule; and $R^9$ and $R^{10}$ are each an alkyl group, an aryl group or a heterocyclic group; and $G^5$ is synonym with $G^1$.

Among Formulas 4, 5, 6, 7 and 8, Formula 4 is preferred.

In Formulas 4, 5, 6, 7 and 8, the 5- or 6-membered heterocyclic ring represented by $Z^1$, $Z^2$, $Z^3$, $Z^4$, $Z^5$, $Z^6$, $Z^7$ $Z^8$ and $Z^9$, is, for example, a thiazoline nucleus, a thiazole nucleus, a benzothiazole nucleus, an oxazoline nucleus, an oxazole nucleus, a benzoxazole nucleus, a selenazoline nucleus, a selenazole nucleus, a benzoselenazole nucleus, 3,3-dialkylindorenine nucleus such as 3,3-dimethyl indolenine, an imidazoline nucleus, an imidazole nucleus, a benzimidazole nucleus, 2-pridine nucleus, 4-pyridine nucleus, a 2-quinoline nucleus, a 4-quinoline nucleus, a 1-isoquinoline nucleus, a 3-isoquinoline, an imidazo[4,5-b] quinoquizaline nucleus, an oxadiazole nucleus, a thiadiazole nucleus, a tetrazole nucleus and a pyrimidine nucleus.

Among them, the benzoxazole nucleus, benzothiazole nucleus, benzimidazole nucleus and quinoline nucleus are preferable and the benzoxazole nucleus and benzothiazole nucleus are more preferable. The benzoxazole nucleus is particularly preferable.

There is no limitation on the substituent represented by V on the group represented by $Z^1$, $Z^2$, $Z^3$, $Z^5$, $Z^6$, $Z^8$ and $Z^9$. Examples of the substituent represented by V include a halogen atom such as a chlorine atom, a bromine atom, an iodine atom and a fluorine atom; a mercapto group; a cyano group; a carboxyl group; a phosphoric group; a sulfo group; a hydroxyl group; a carbamoyl group having from 1 to 10, preferably from 2 to 8, more preferably from 2 to 5, carbon atoms such as a methylcarbamoyl group, an ethylcarbamoyl group and a morpholinocarbonyl group; a sulfamoyl group having from 1 to 10, preferably from 2 to 8, more preferably from 2 to 5, carbon atoms such as a methylsulfamoyl group, an ethylsulfamoyl group and a piperidinosulfamoyl group; a nitro group; an alkoxy group having from 1 to 20, preferably from 1 to 10, more preferably from 1 to 8, carbon atoms such as a methoxy group, an ethoxy group, 2-methoxyethoxy group and a 2-phenylethoxy group; an aryloxy group having from 6 to 20, preferably from 6 to 12, more preferably from 6 to 10, carbon atoms such as a phenoxy group, a p-methylphenoxy group, p-cholorphenoxy group and a naphthoxy group; an acyl group having from 1 to 20, preferably from 2 to 12, more preferably from 2 to 8, carbon atoms such as an acetyl group, a benzoyl group and a trichloroacetyl group; an acyloxy group having from 1 to 20, preferably from 2 to 12, more preferably from 2 to 8, carbon atoms such as an acetoxy group and a benzoyloxy group; an acylamino group having from 1 to 20, preferably from 2 to 12, more preferably from 2 to 8, carbon atoms such as an acetylamino group and a benzoylamino group; a sulfinyl group having from 1 to 20, preferably from 1 to 10, more preferably from 1 to 8, carbon atoms such as a methanesulfonyl group, an ethanesulfonyl group and a benzenesulfonyl group; a sulfinyl group having from 1 to 20, preferably from 1 to 10, more preferably from 1 to 8, carbon atoms such as a methanesulfinyl group and a benzenesulfinyl group; a sulfonylamino group having from 1 to 20, preferably from 1 to 10, more preferably from 1 to 8, carbon atoms such as a methanesulfonylamino group, an ethanesulfonylamino group and a benzenesulfonylamino group; a substituted amino group having from 1 to 20, preferably from 1 to 12, more preferably from 1 to 8, carbon atoms such as a methylamino group, a dimethylamino group, a benzylamino group, an aniline group and a diphenylamino group; an ammonium group having from 0 to 15, preferably from 3 to 10, more preferably from 3 to 6, carbon atoms such as a trimetylammonium group and a triethylammonium group; a hydrazino group having from 0 to 15, preferably from 1 to 10, more preferably from 1 to 6, carbon atoms such as a trimethylhydrazino group; a ureido group having from 1 to 15, preferably from 1 to 10, more preferably from 1 to 6, carbon atoms such as a ureido group and an N,N-dimethylureido group; an imido group having from 1 to 15, preferably from 1 to 10, more preferably from 1 to 6, carbon atoms such as a succinimido group; an alkylthio and an arylthio group having from 1 to 20, preferably from 1 to 12, more preferably from 1 to 8, carbon atoms such as a methylthio group, an ethylthio group, a carboxyethylthio group, a sulfobutylthio group and a phenylthio group; an alkoxycarbonyl group having from 2 to 20, preferably from 2 to 12, more preferably from 2 to 8, carbon atoms such as a methoxycarbonyl group, an ethoxycarbonyl group and a benzyloxycarbonyl group; an aryloxycarbonyl group having from 6 to 20, preferably from 6 to 12, more preferably from 6 to 8, carbon atoms such as a phenoxycarbonyl group; an unsubstituted alkyl group having from 1 to 18, preferably from 1 to 10, more preferably from 1 to 5, carbon atoms such as a methyl group, an ethyl group, a propyl group and a butyl group; a cyclic alkyl group having from 3 to 6 carbon atoms such as a cyclopropyl group, a cyclobutyl group, a cyclopentyl group and a cyclohexyl group; a substituted alkyl group having from 1 to 18, preferably from 1 to 10, more preferably from 1 to 5, carbon atoms such as a hydroxymethyl group, a trifluoromethyl group, a benzyl group, a carboxyethyl group, an ethoxycarbonylmethyl group and an acetylaminomethyl group; an unsaturated carbon hydride group having from 2 to 18, preferably from 3 to 10, more preferably from 3 to 5, carbon atoms such as a vinyl group, an ethynyl group, a 1-cyclohexenyl group, a benzylidine group and a benzylidene group; an unsubstituted aryl group having from 6 to 20, preferably from 6 to 15, more preferably from 6 to 10, carbon atoms such as a phenyl group, a naphthyl group, a p-carboxyphenyl group, a p-nitrophenyl group, a 3,5-dichlorophenyl group, a p-cyanophenyl group, m-fluorophenyl group and a p-tolyl group; and a heterocyclic group, which may substituted by a substituent, having from 1 to 20, preferably from 2 to 10, more preferably from 4 to 6, carbon atoms such as a pyridyl group, a methylpyridyl group, a thienyl group, a furyl group, a morpholino group and a tetrahydrofrufryl group. These groups each may be form a structure condensed with a benzene ring, a naphthalene ring or an anthrathene ring. A group represented by V may further substitute on each of the above-described groups.

The above-described alkyl group, aryl group, alkoxy group, halogen atom, acyl group, cyano group, sulfinyl group and benzene condensed ring are preferable as the substituent of $Z^1$, $Z^2$, $Z^3$, $Z^5$, $Z^6$, $Z^8$ and $Z^9$. The alkyl group, phenyl group, methoxy group, chlorine atom, bromine atom, iodine atom and benzene condensed ring are preferable and the phenyl group, chlorine atom, bromine atom and iodine atom are most preferable.

$R^1$, $R^2$, $R^3$, $R^4$, $R^5$, $R^6$, $R^7$, $R^8$, $R^9$ and $R^{10}$ are each an alkyl group, an aryl group, and a heterocyclic group. Examples of such groups include an unsubstituted alkyl group having from 1 to 18, preferably from 1 to 7, more preferably from 1 to 4, carbon atoms such as a methyl group, an ethyl group, a propyl group, a butyl group, an isobutyl group, a hexyl group, an octyl group, a dodecyl group and an octadecyl group; a substituted alkyl group having from 1 to 18, preferably from 1 to 7, more preferably from 1 to 4, carbon atoms such as an alkyl group substituted by the forgoing group represented by V described as the substituent of $Z^1$. Preferable examples of such substituted alkyl group include an aralkyl group such as a benzyl group and 2-phenylethyl group; an unsaturated carbon hydride group such as an allyl group; a hydroxyalkyl group such as a 2-hydroxyethyl group and a 3-hydroxypropyl group; a carboxyalkyl group such as a 2-carboxyethyl group, 3-caboxypropyl group, 4-carboxybutyl group and a carboxymethyl; an alkoxyalkyl group such as a 2-methoxyethyl group, 2-(2-methoxyethoxy)ethyl group; an aryloxy group such as a 2-phenoxyethyl group and a 2-(1-naphthoxy)ethyl group; an alkoxycarbonylalkyl group such as an ethoxycarbonylmethyl group and a 2-benzyloxycarbonylethyl group; an aryloxycarbonylalkyl group such as a 3-phenoxycarbonylpropyl group; an acyloxyalkyl group such as a 2-acetyloxyethyl group; an acylalkyl group such as a 2-acetylethyl group; a carbamoylalkyl group such as a 2-morphlinocarbonylethyl group; a sulfamoylalkyl group such as N,N-dimethylcarbamoylmethyl group; a sulfoalkyl group such as a 2-sulfoethyl group, a 3-sulfopropyl group, a 3-sulfobutyl group, a 4-sulfobutyl group and 2-hydroxy-3-sulfopropyl group; a sulfoalkenyl group such as a sulfopropenyl group; a sulfatoalkyl group such as a 2-sulfatoethyl group, a 3-sulfatopropyl group and a 4-sulfatobutyl group; an alkyl group substituted by a heterocyclic group such as a 2-(pyrrolidone-2-on-1-il)ethyl group and a tetrahydrofurfuryl group; an alkylsulfonylcarbamoylmethyl group such as methanesulfonylcarbamoylmethyl group. Examples of the group represented by $R^1$, $R^2$, $R^3$, $R^4$, $R^5$, $R^6$, $R^7$, $R^8$, $R^9$ or $R^{10}$ further include an unsubstituted aryl group having from 6 to 20, preferably from 6 to 10, more preferably from 6 to 8, carbon atoms such as a phenyl group and a 1-naphthyl group; a substituted aryl group having from 6 to 20, preferably from 6 to 10, more preferably from 6 to 8, carbon atoms such as an aryl group substituted by the group represented by V described as the substituent of $Z^1$, for example, a p-methoxyphenyl group, a p-methylphenyl group and p-chlorophenyl group; an unsubstituted heterocyclic group having from 1 to 20, preferably from 3 to 10, more preferably from 4 to 8, carbon atoms such as a 2-furyl group, a 2-thienyl group, a 2-pyridyl group, a 3-pyrazolyl group, a 3-iso-oxazolyl group, 3-iso-thiazolyl group, a 2-imidazolyl group, a 2-oxazolyl group, a 2-thazolyl group, a 2-pyridazyl group, a pyrimidinyl group, a 3-pyrazyl group, a 2-(1,3,5-triazolyl) group, a 3-(1,2,4-triazolyl) group and a 5-tetrazolyl group; and a substituted heterocyclic group having from 1 to 20, preferably from 3 to 10, more preferably from 4 to 8, carbon atoms such as a heterocyclic group substituted by the group represented by V as the substituent of $Z^1$, for example, a 5-methyl-2-thienyl group and a 4-methoxy-2-pyridyl group.

$R^1$, $R^2$, $R^3$, $R^4$, $R^5$, $R^6$, $R^7$, $R^8$, $R^9$ or $R^{10}$ are each preferably the foregoing unsubstituted alkyl group, carboxyalkyl group, sulfoalkyl group, sulfoalkenyl group, unsubstituted aryl group or unsubstituted heterocyclic group, more preferably methyl group, ethyl group, 2-sulfoethyl group, 3-sulfopropyl group, 3-sulfobutyl group, 4-sulfobutyl group, carboxymethyl group, phenyl group, 2-pyridyl group or 2-thiazolyl group.

$Z^4$ is a group of atoms necessary to complete an acidic nucleus it may be a state of the acidic nucleus of a usual merocyanine dye. The acidic nucleus is defined by the description of "The Theory of the Photographic Process", 4 th ed., p. 198, edited by James, Mcmillan Publishing Co., Inc., 1977. Concrete examples of the acidic nucleus include those described in U.S. Pat. Nos. 3,567,719, 3,575,869, 3,804,634, 3,837,862, 4,002,480 and 4,925,777, Japanese Patent Publication Open to Public Inspection, hereinafter referred to as JP O.P.I. Publication, No. 3-167546. An acidic nucleus of 5- or 6-membered nitrogen-containing heterocyclic ring constituted by a carbon atom, a nitrogen atom and an atom of chalcogen element such as oxygen, sulfur, selenium and tellurium is preferable. Examples of the nucleus are followings: a nucleus of 2-pyrazoline-5-one, pyrazolidine-3,5-dione, imidazoline-5-one, hydantoin, 2- or 4-thiohydantoin, 2-iminooxazolidine-4-one, 2-oxazoline-5-one, 2-oxazoline-5-one, 2-thiooxazoline-2,4-dione, iso-oxazoline-5-one, 2-thiazoline-4-one, thiazolidine-4-one, thiazolidine-2,4-dione, rhodanine, thiazolidine-2,4-dione, iso-rhodanine, indane-1,3-dione, thiophene-3-one, thiophene-3-one-1,1-dioxide, indoline-2-one, indoline-3-one, 2-oxoindazolinium, 3-oxoindalizonium, 5,7-dioxo-6,7-dihydrothiazolo[3,2-a]pyrimidine, cyclohexane-1,3-dione, 3,4-dihydroisoquinoline-4-one, 1,3-dioxane-4,6-dione, barbituric acid, 2-thiobarbituric acid, chroman-2,4-dione, indazoline-2-one, pyrido[1,2-a]pyrimidine-1,3-dione, pyrazolo[1,5-b]quinazolone, pyrazolo[1,5-b]benzimidazole, pyrazolopyridone, 1,2,3,4-tetrahydroquinoline-2,4-dione, 3-oxo-2,3-dihydrobenzo[d]thiophene-1,1-dioxide and 3-dicyanomethine-2,3-dihydrobenzo[d]thiophene-1,1-dioxide.

As $Z^4$, hydantoin, 2- or 4-thiohydantoin, 2-oxazolin-5-one, 2-thiooxazoline-2,4-dione, thiazolidine-2,4-dione, rhodanine, thiazolidine-2,4-dithione, barbituric acid, and 2-thiobarbituric acid are preferable. Among them, hydantoin, 2- or 4-thiohydantoin, 2-oxazolin-5-one, rhodanine, barbituric acid and 2-thiobarbituric acid are more preferable. 2- or 4-thiohydantoin and 2-oxazolin-5-one and rhodanine are particularly preferable.

The 5- or 6-membered nitrogen-containing heterocyclic group represented by $Z^7$ or $Z^{10}$ is one formed by eliminating the oxo group or the thioxo group from the heterocyclic group represented by $Z^4$. One formed by elimination the oxo or thioxo group from the hydantoin, 2- or 4-thiohydantoin, 2-oxazoline-5-one, 2-thiooxazoline-2,4-dione, thiazolidine-2,4-dione, rhodanine, thiazolidine-2,4-dithione, barbituric acid or 2-thiobarbituric acid is preferable, and one formed by eliminating the oxo group or thioxo group from 2- or 4-thiohydantoin, 2-oxazoline-5-one or rhodanine is particularly preferable.

Examples of $G^2$ and $G^3$ include a cyano group; an ester group such as an ethoxycarbonyl group and a methoxycarbonyl group; an acyl group; a carbamoyl group; an alkylsulfonyl group such as an ethylsulfonyl group and a methylsulfonyl group; an arylsulfonyl group such as a phenylsulfonyl group and a tolylsulfonyl group; an alkylsulfinyl group such as an ethylsulfinyl group and a methylsulfinyl group; an arylsulfinyl group such as a phenylsulfinyl group and a naphthylsulfinyl group; and a sulfamoyl group such as a methylsulfamoyl group and a dimethylsulfamoyl group.

As $G^4$, a substituted and unsubstituted amino group and a substituted and unsubstituted aryl group are preferred. The substituent of each of such groups is the same as the foregoing groups represented by V.

$L^1$, $L^2$, $L^3$, $L^4$, $L^5$, $L^6$, $L^7$, $L^8$, $L^9$, $L^{10}$, $L^{11}$, $L^{12}$, $L^{13}$, $L^{14}$, $L^{15}$, $L^{16}$, $L^{17}$, $L^{18}$, $L^{19}$, $L^{20}$, $L^{21}$, $L^{22}$, $L^{23}$, $L^{24}$, $L^{25}$, $L^{26}$, $L^{27}$, $L^{28}$, $L^{29}$ and $L^{30}$ are each a methine group. The methine group represented by each of $L^1$ through $L^{30}$ may have a substituent. Examples of the substituent of the methine group include a substituted or unsubstituted alkyl group having from 1 to 15, preferably from 1 to 10, more preferably from 1 to 5, carbon atoms such as a methyl group, an ethyl group and 2-carboxyethyl group; a cyclic alkyl group having from 3 to 7, preferably from 3 to 6, carbon atoms such as a cyclopropyl group, a cyclopentyl group and a cyclohexyl group; a substituted or unsubstituted aryl group having from 6 to 20, preferably from 6 to 15, more preferably from 6 to 10, carbon atoms such as a phenyl group, and an o-carboxylphenyl group; a substituted or unsubstituted heterocyclic group having from 3 to 20, preferably from 4 to 15, more preferably from 6 to 10, carbon atoms such as a furyl group, a thienyl group, an N,N-diethylbarbituric acid group; a halogen atom such as a chlorine atom, a bromine atom, a fluorine atom and an iodine atom; an alkoxy group having from 1 to 15, preferably from 1 to 10, more preferably from 1 to 5, carbon atoms such as a methoxy group and an ethoxy group; an alkylthio group having from 1 to 15, preferably from 1 to 10, more preferably from 1 to 5, carbon atoms such as a methylthio group and an ethylthio group; an arylthio group having from 6 to 20, preferably from 6 to 15, more preferably from 6 to 10, carbon atoms such as a phenylthio group; and an amino group having from 0 to 15, preferably from 2 to 10, more preferably from 4 to 10, carbon atoms such as an N,N-methyl-diphenylamino group an N-methyl-N-phenylamino group, and an N-methylpiperadino group. The methine group may be bonded to form a ring with another methine group or a group represented by $R^1$, $R^2$, $R^3$, $R^4$, $R^5$, $R^6$, $R^7$, $R^8$, $R^9$, $R^{10}$, $Z^1$, $Z^2$, $Z^3$, $Z^4$, $Z^5$, $Z^6$, $Z^8$, $Z^9$ $Z^{10}$.

n1, n2, n3, n4 and n6 are each preferably 0, 1 or 2, more preferably 0 or 1 and further preferably 1. n5 and n7 are each preferably 0 or 1, more preferably 0. When n1, n2, n3, n4, n5, n6 and n7 are 2 or more, the methine groups are repeated, but they are not necessary to be the same.

$M^1$, $M^2$, $M^3$, $M^4$ and $M^5$ are each contained in the formula to show the presence of a cation or an anion when they are necessary to neutralize the ionic charge of the dye. Examples of the typical cation include an inorganic cation, for example, a hydrogen ion $H^+$; an alkali metal ion such as a sodium ion, a potassium ion and a lithium ion; and an alkali-earth metal ion such as a calcium ion; and an organic cation, for example, an ammonium ion, a tetraalkylammonium ion, a pyridinium ion and an ethylpyridinium ion. The anion may either be an inorganic anion or an organic anion. Examples of the anion include a halogen anion such as a fluorine ion, a chlorine ion, an iodine ion; a substituted arylsulphonic acid ion such as p-toluenesulphonic acid ion and a p-chlorobenzenesulfophonic acid ion; an aryldisulphonic acid ion such as a 1,3-benzenedisulphonic acid ion, 1,5-naphthalene-disulphonic acid ion and 2,6-naphthalenedisulphonic ion; an alkylsulfric acid ion such as a methylsulfric acid ion; a sulfuric ion; a thiocyanate ion, a perchlorate ion; a tetrafluoroboric acid ion, a picric ion; an acetic ion and a trifluoromethanesulphonic acid ion. An ionic polymer or another dye having a charge reverse to the polarity of the dye may be used. The sulfo group is described here as $SO_3$, however, it can be described as $SO_3H$ when it has a hydrogen ion as a counter ion. $m^1$, $m^2$, $m^3$, $m^4$ and $m^5$ are each a number necessary to equalize the charge, and are each 0 when an intramolecular salt is formed. P1, p2, p3, p4, p5, p6 and p7 are each independently 0 or 1; preferably 0.

Concrete examples of the dye usable in the invention are shown below, but the dye to be used in the invention is not limited thereto.

Dye-1

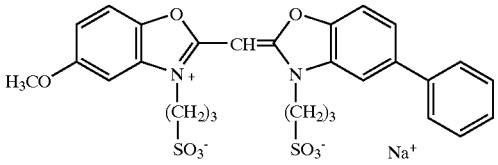

Dye-2

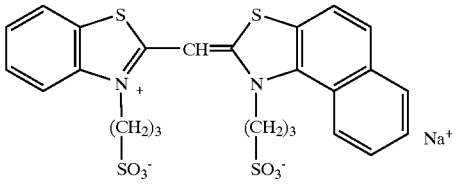

Dye-3

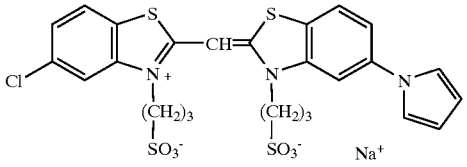

Dye-4

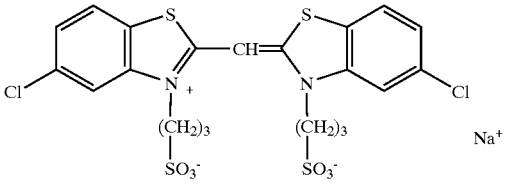

Dye-5

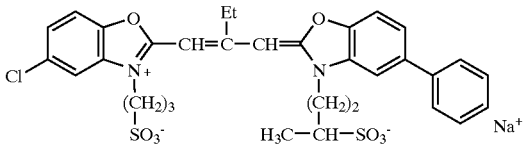

Dye-6

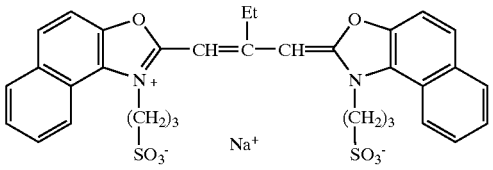

-continued
Dye-7
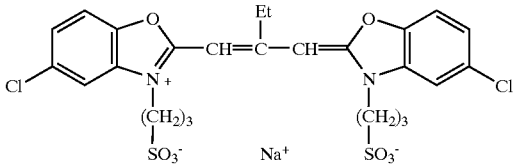
Dye-8
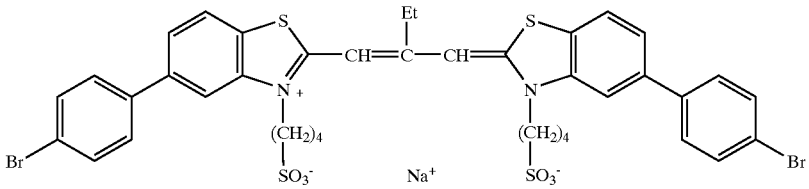
Dye-9
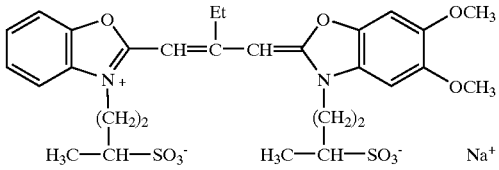
Dye-10
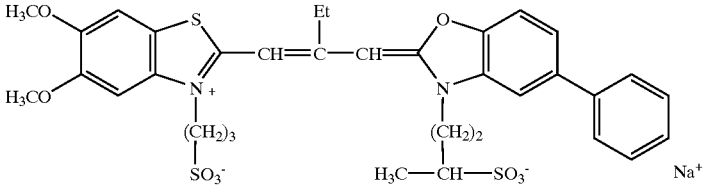
Dye-11
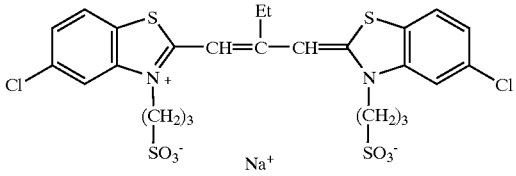
Dye-12
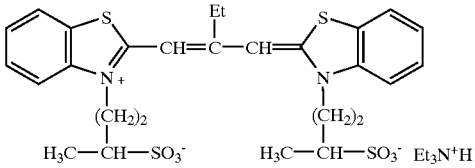
Dye-13
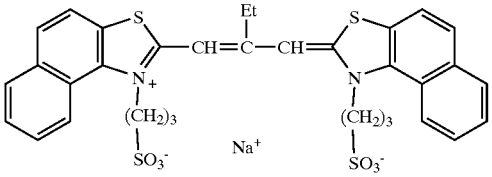
Dye-14
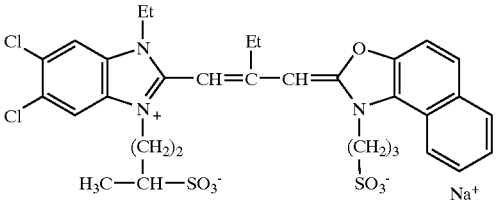
Dye-15
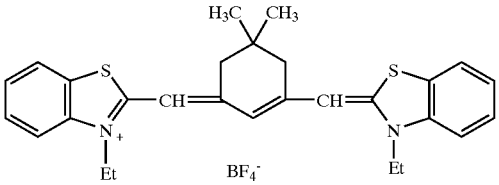
Dye-16
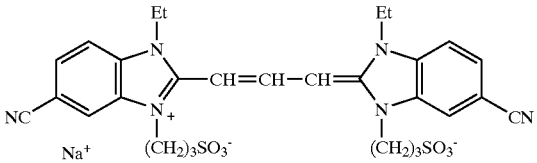
Dye-17
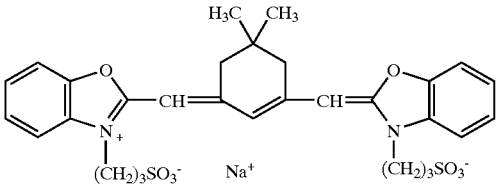
Dye-18
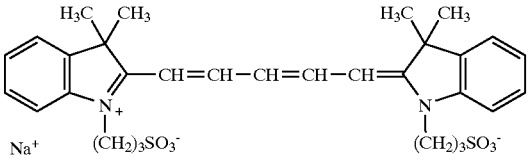

-continued

Dye-19

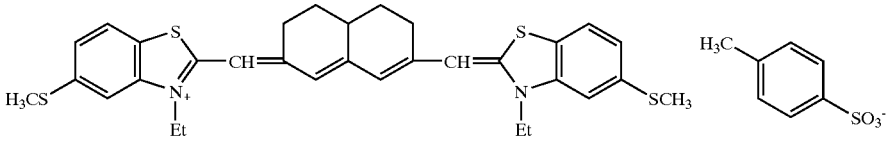

Dye-20

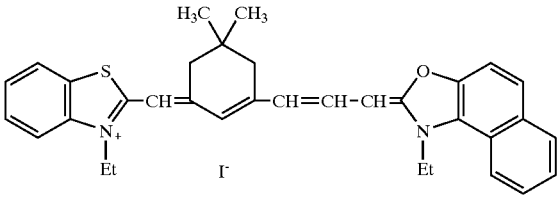

Dye-21

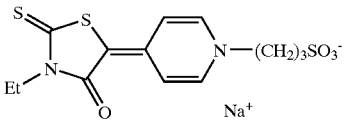

Dye-22

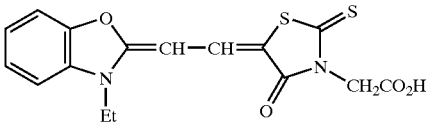

Dye-23

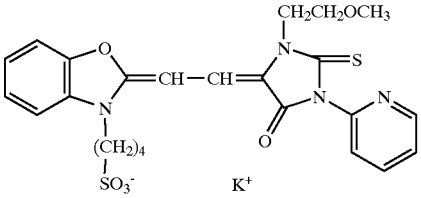

Dye-24

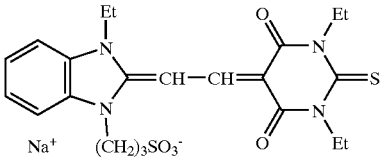

Dye-25

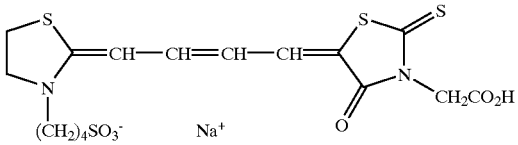

Dye-26

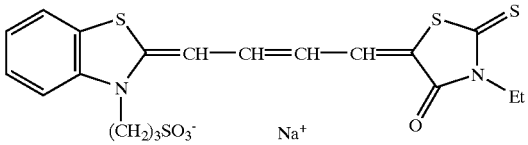

The light absorption group represented by Z in Formula (II) may be any dye, preferably the cyanine dye, merocyanine dye, rhodacyanine dye tri-nucleus-merocyanine dye, holopolar dye, hemicyanine dye and styryl dye.

$$(Z)_{k1}[(L)_{k3}X]_{k2} \qquad \text{Formula (II)}$$

Examples of the light absorption group represented by Z include a group having a structure in which the forgoing sensitizing dye is substituted on L of Formula (II), for example, a compound in which L of Formula (II) is substituted on at least one of $R^1$, $R^2$, $Z^1$, $Z^2$, $L^3$, $L^4$ and $L^5$ of Formula 4, $R^3$, $R^4$, $Z^3$, $Z^4$, $L^{10}$, $L^{11}$, $G^2$ and $G^3$ of Formula 5, $R^5$, $Z^5$, $L^{14}$, $L^{15}$ and $G^4$ of Formula 6, $R^6$, $R^7$, $R^8$, $R^6$, $R^7$, $R^8$, $L^{18}$, $L^{19}$, $L^{20}$, $L^{21}$ and $L^{22}$ of Formula 7, and $R^9$, $R^{10}$, $Z^9$, $Z^{10}$, $L^{10}$, $L^{27}$, $L^{28}$, $L^{29}$, $L^{30}$ and $G^5$ of Formula 8.

The silver halide adsorption group represented by Z of Formula (II) is a substituent containing at least one of N, S, P, Se and Te atom, for example, a thiourea group, a thiourethane group, a mercapto group, a thioether group, a thione group, a heterocyclic group, a thioamidoheterocyclic group, a mercaptoheterocyclic group and a adsorption group described in JP O.P.I. Publication No. 64-90439.

Examples of the silver ligand include a sulfur acid and its analogue of selenium or tellurium, a nitrogen acid, a thioester and its analogue of selenium or tellurium, phosphor, a thioamide, a selenamide, a telluramide and a carbon acid. The acid compound is preferably one having an acid dissociation constant pKa of from 5 to 14. The silver ligand is preferably one capable of accelerating adsorption to silver halide. A mercaptan and a thiol are preferable as the sulfur acid which forms a double salt with a silver ion. The thiol having a stable C—S bond is used as an adsorption group to silver, not as a sulfide ion precursor. Refer "The Theory of the Photographic Process", 1977, p.p. 32–34. An alkyl group having an R"—SH group or an R""—$SO_2$—SH group, an arylthiol and is analogue of selenium or tellurium are usable. In the above, each R" and R"" is independently an aliphatic group, an aromatic group or a heterocyclic group, they may be substituted with a group represented by the forgoing V, preferably substituted with a group containing a halogen atom, an oxygen atom, a sulfur atom or a nitrogen atom.

A heterocyclic thiol group containing an oxygen atom, a sulfur atom, a tellurium atom or a nitrogen atom is more preferable. Such group is represented by the following Formula 11.

Formula 11

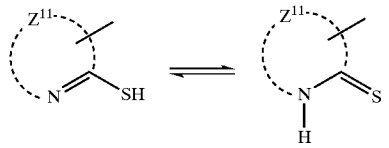

In the above formula, $Z^{11}$ is a heterocyclic group, preferably a 5- or 6-membered heterocyclic group, having one or more hetero atom such as a nitrogen atom, an oxygen atom, a sulfur atom, a selenium atom and a tellurium atom. The heterocyclic group may form a condensed ring with a benzene ring or a naphthalene ring. The group having a nitrogen atom conjugated with a thiol group has tautomeric forms of mercaptan —N═C—SH and thioamide —NH—C═S. Examples of the heterocyclic thiol silver ligand preferably used in the invention include mercaptotetrazole, mercaptoimidazole, mercaptothiadiazole, mercaptobenzothiazole, mercaptobenzoxazole, mercaptopyrimidine, mercaptotriazine, phenylmercaptotriazole, 1,4,5-trimethyl-1,2,4-triazolium-3-thilate and 1-methyl-4,5-diphenyl-1,2,4-triazolium-3-thiolate.

A nitrogen acid capable of being protonated is effective as the silver ligand. Many nitrogen acids are each a 5- or 6-membered heterocyclic ring containing one or two nitrogen atoms, a sulfur atom, a selenium atom or a tellurium atom, which are represented, for example, by the following Formula 12, 13 or 14.

Formula 12

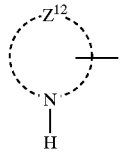

Formula 13

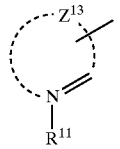

Formula 14

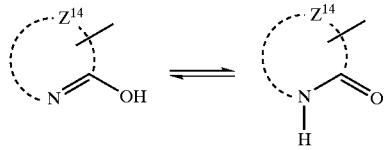

In the above formulas, $Z^{12}$ is preferably a 5- or 6-membered heterocyclic ring containing one or more heteroatoms such as a nitrogen atom, an oxygen atom, a sulfur atom, a selenium atom and a tellurium atom. The heterocyclic group may be condensed with a benzene ring or a naphthalene ring. $Z^{13}$ is preferably a 5- or 6-membered heterocyclic ring containing one or more hetero atom such as a nitrogen atom, an oxygen atom, a sulfur atom, a selenium atom and a tellurium atom. The heterocyclic group may be condensed with a benzene ring or a naphthalene ring. $R^{11}$ is an aliphatic group, an aromatic group or a heterocyclic group. The heterocyclic group represented by $Z^{12}$, $Z^{13}$ or $R^{11}$ may be substituted with the forgoing group represented by V, preferably a group containing a halogen atom, an oxygen atom, a sulfur atom, or a nitrogen atom. $Z^{14}$ is preferably a 5- or 6-membered heterocyclic group one or more hetero atom such as a nitrogen atom, an oxygen atom, a sulfur atom, a selenium atom and a tellurium atom, such heterocyclic group may be condensed with a benzene ring or a naphthalene ring.

Among the heterocyclic nitrogen acids, an azole, a purine, a hydroxyazaindene and an imide are preferable, which are described in U.S. Pat. No. 2,857,274, and a uracil, a tetrazole, a benzotriazole, a benzotriazole, a benzoxazole, an adenine, a rhodanine and a 1,3,3a,7-tetraazaindene such as 5-bromo-4-hydroxy-6-methyl-1,3,3a,7-tetrazaindene are most preferable.

Preferable cyclic and non-cyclic thioester and there analogue of selenium or tellurium are described in U.S. Pat. No. 5,246,827. The preferable structures thereof are shown below.

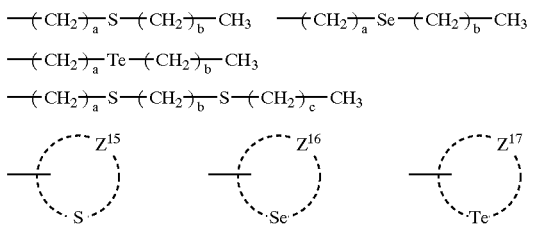

In the above formulas, a, b and c are each an integer of from 1 to 30, provided that the sum of a, b and c is not more than 30. $Z^{15}$, $Z^{16}$ and $Z^{17}$ are each a group of atoms for forming a 5- through 18-membered ring, preferably a 5-through 8-membered ring. The ring may contain one or more atoms of sulfur, selenium or tellurium. Among them, a $—CH_2CH_2SCH_2CH_3$ group, a 1,10-dithia-4,7,13,16-tetraoxacyclooctadecanyl group, a $—CH_2CH_2SeCH_2CH_3$ group, a $—CH_2CH_2TeCH_2CH_3$ group, a $—CH_2CH_2SCH_2CH_2SCH_2CH_3$ group and a thiomorpholinyl group are particularly preferred.

Phosphor is frequently used as Z, which is an active ligand of silver halide. Preferable phosphor compounds are represented by $(R^{12})_3$—P. $R^{12}$ is an aliphatic group, an aromatic group or a heterocyclic group, they may be substituted with the group represented by V, preferably with a halogen atom, an oxygen atom, a sulfur atom or a nitrogen atom. Particularly preferred compound is $P(CH_2CH_2CH)_3$ and m-sulfophenyldimethylphosphine.

A thioamide, a thiosemicarbazide, a tellurourea and a selenourea each having the following formula are preferably usable.

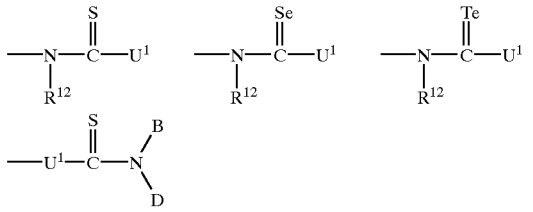

In the above formulas, $U^1$ is a substituted or unsubstituted amino group, a substituted or unsubstituted hydrazino group, a substituted or unsubstituted alkylthio group, a substituted or unsubstituted arylthio group, a substituted or unsubstituted alkoxy group or a substituted or unsubstituted aryloxy group. As the substituent of these groups, the groups represented by V are cited. B and D are each an aliphatic group, an aromatic group or a heterocyclic group; they may be bonded with together to form a 5- or 6-membered ring. $R^{12}$ is an aliphatic group, an aromatic group or a heterocyclic group; each of them may have a substituent. As the substituent of these groups, the groups represented by V are applicable.

Many thioamide silver ligands are described in U.S. Pat. No. 3,598,598. Preferable thioamide is an N,N'-tetraalkylthiourea, N-hydroxyethylbenzothiazoline-2-one, phenyldimethyldithiocarbamate and N-substituted thiazoline-2-one.

A carbon acid conducted by a reactive methylene group having an acid dissociation constant of from 5 to 14 is also preferably used. Examples of such compound include bromomalononitrile, 1-methyl-3-methyl-1,3,5-trithiane bromide and acetylene. It is described in Canadian Patent No. 1,080,532 and U.S. Pat. No. 4,374,279 that the carbon acid functions as the silver ligand. Ones represented by the followings are preferably used as the carbon acid.

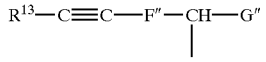

$R^{13}$ is an aliphatic group, an aromatic group or a heterocyclic group; they may be substituted with the group represented by V, preferably with a halogen atom, an oxygen atom, a sulfur atom or a nitrogen atom. F" and G" are each independently a substituent capable of making the pKa of the CH to a value from 5 to 14. Such substituent may be selected from a $—CO_2R^{13}$ group, a $—COR^{13}$ group, a —CHO group, a —CN group, an $—SO_2R^{13}$ group, an $—SOR^{13}$ group and an $—NO_2$ group.

A cationic surfactant also functions as the group of adsorption to silver halide. The cationic surfactant has a carbon hydride group having four or more carbon atoms which may be substituted with a halogen atom, an oxygen atom, a sulfur atom or a nitrogen atom. Examples of the cationic moiety of such surfactant include an ammonium group, a sulfonium group and a phosphonium group. Such cationic surfactants are described in "Journal of Colloid-interface Society", Vol. 22, P. 391, 1966. Preferable examples of the cationic surfactant include dimethyldodecylsulfonium, tetradecyltrimethylammonium, N-dodecylnicotinic betaine and decamethylenepyridinium ion.

Preferable examples of the moiety for adsorbing to silver halide include an alkylmercaptan, a cyclic or non-cyclic thioether, benzothiazole, tetraazaindene, benzotriazole, tetraalkylthiourea, mercapto-substituted a hetercyclic compound such as mercaptotetrazole, mercaptotriazole, mercaptothiadiazole, mercaptoimidazole, mercaptooxadiazole, mercaptothiazole, mercaptobenzimidazole, mercaptobenzothiazole, mercaptobenzoxazole, mercaptopyrimidine, mercaptotriazine, phenylmercaptotetrazole and 1,2,4-triazoliumthiolate.

Preferable examples of the group for adsorbing to silver halide represented by Z of Formula (II) are shown below, but the adsorption group is not limited thereto.

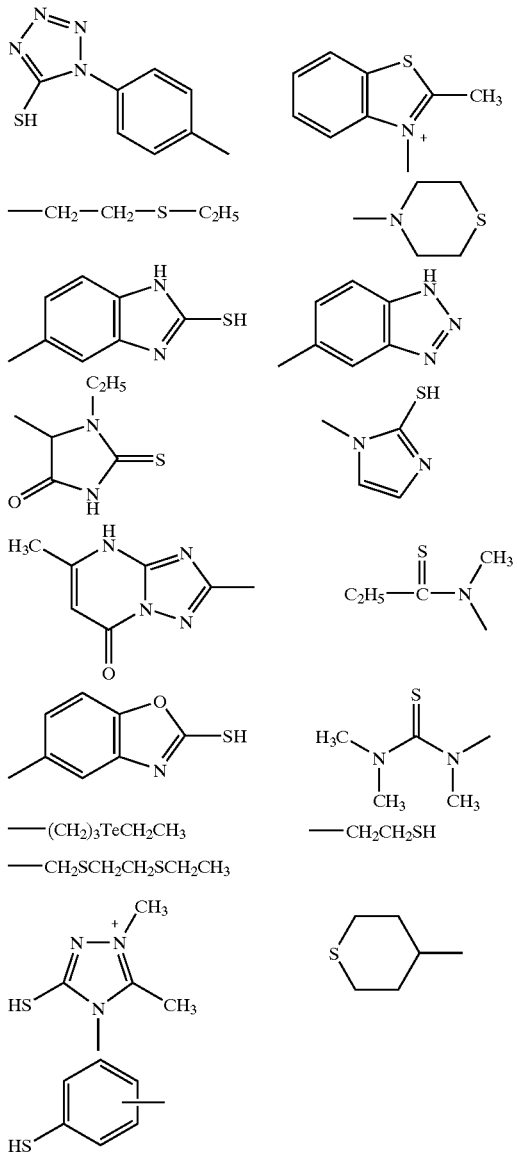

L in Formula (II) are each a di-valent bonding group or a single bond. The bonding group is an atom or a group of atoms containing at least one of a carbon atom, a nitrogen atom, a sulfur atom and an oxygen atom. Such bonding group is a di-valent bonding group having from 1 to 20 carbon atoms which is constituted by one or a combination of the following groups: an alkylene group such as a methylene group, an ethylene group, a propylene group, a butylene group and a pentylene group; an arylene group such as a phenylene group and a naphthylene group; an alkenylene group such as an ethenylene group and a propenylene group; an alkynylene group such an ethynylene group and a propynylene group; an amido group; an ester group; a sulfonamide group; a sulfonate group; a ureido group; a sulfonyl group; a sulfinyl group; a thioether group; an ether group; a carbonyl group an —N(Ra)— group in which Ra is a hydrogen atom, a substituted or unsubstituted alkyl group or a substituted or unsubstituted aryl group; and a di-valent heterocyclic group such as 6-chloro-1,3,5-triazine-2,4-di-yl and quinoquizaline-2,3-di-yl. More preferable bonding group is a di-valent bonding group having from 1 to 10 carbon atoms which is constituted by on or a combination of one or more of the following groups: an alkylene group having from 1 to 4 carbon atoms such as a methylene group, an ethylene group, a propylene group and a butylenes group; an arylene group having from 6 to 10 carbon atoms such as a phenylene group and a naphthylene group; an alkenylene group having from 1 to 4 carbon atoms such as an ethenylene group and a propenylene group; and an alkynylene group having from 1 to 4 carbon atoms such as an ethynylene group and a propynylene group. The forgoing groups may have a substituent. In concrete, the following groups are preferably used.

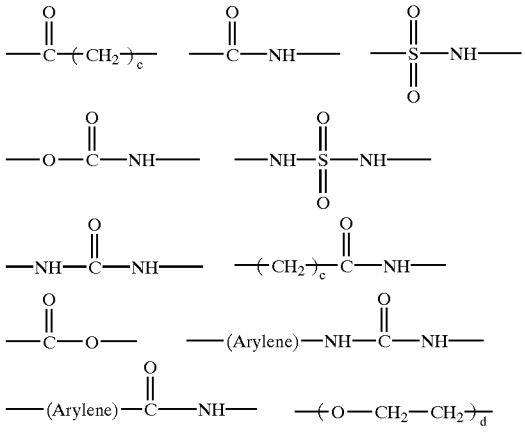

1: (c = 1–30, d = 1–10)
c and d are each preferably from 3 to 10.

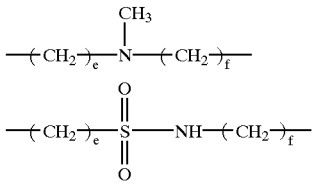

-continued

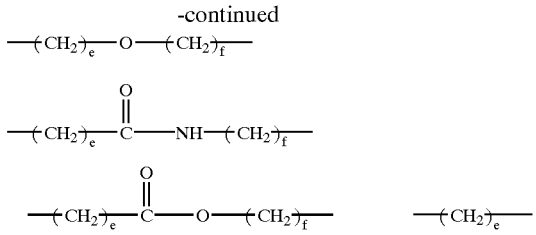

2: e, f = 1–30, provided, e + f is not more than 30.

The compound represented by Formula (I) or Formula (II) is "a compound capable of forming a (n+m)-valent cation from an n-valent cation radical with an intramolecular cyclization reaction". Concrete examples of such compound are described in detail in Journal of Synthetic Organic Chemistry, Japan, vol. 49, No. 7, p.p. 636–644, 1991. The compound is a compound capable of forming a (n+m)-valent cation, a di-valent cation in the following example, from an n-valent cationic radical, a mono-valent cation radical in the following example, with an intramolecular cyclization reaction by the following reaction mechanism.

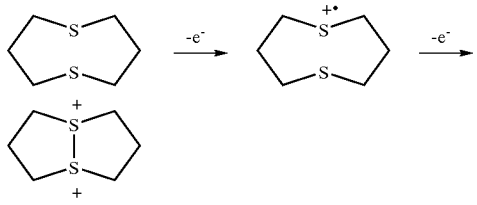

Concrete examples of Formulas (I) and (II) are shown below but the compounds usable in the invention are not limited thereto.

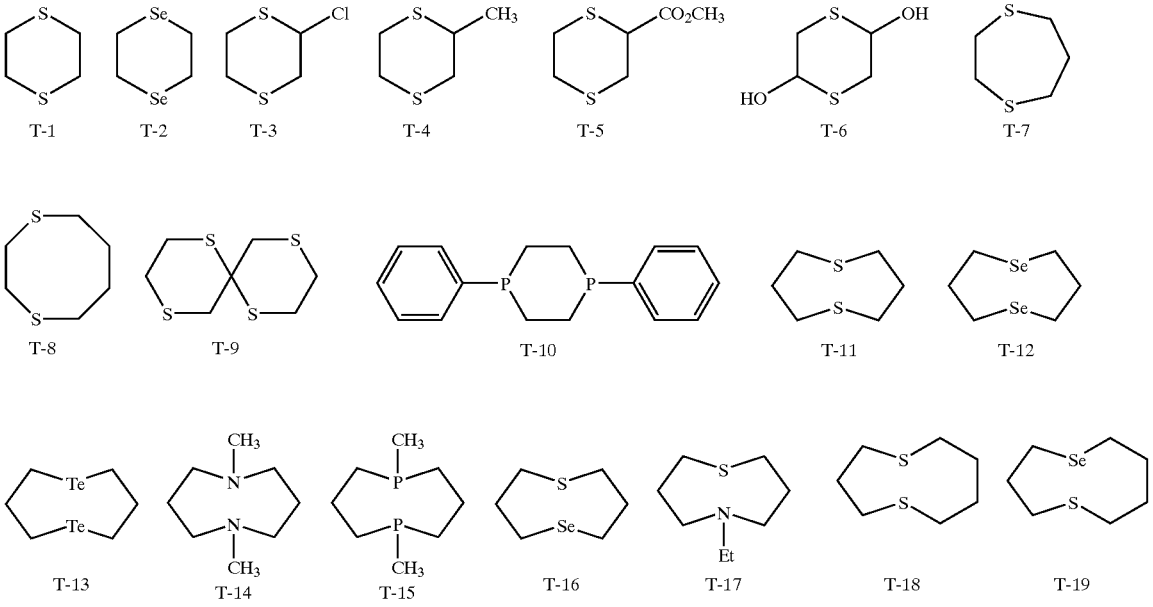

-continued
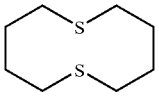
T-20
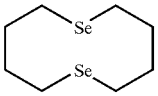
T-21
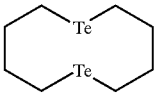
T-22
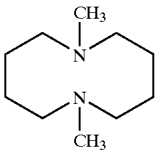
T-23
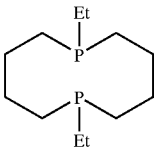
T-24
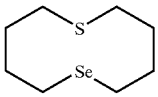
T-25
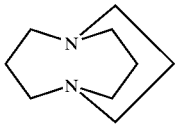
T-26
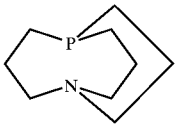
T-27
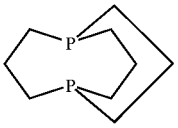
T-28
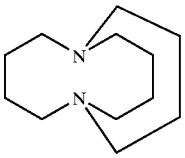
T-29
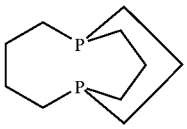
T-30
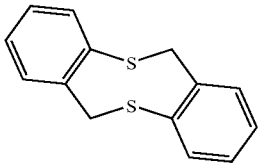
T-31
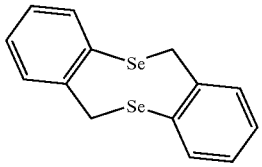
T-32
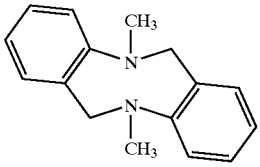
T-33
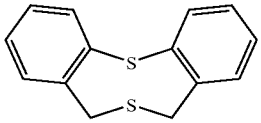
T-34
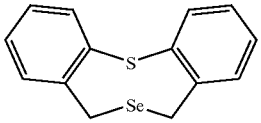
T-35
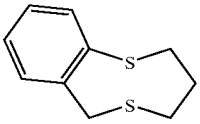
T-36
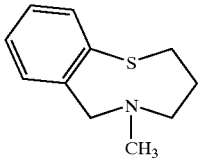
T-37
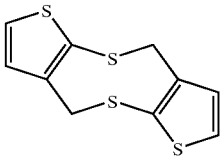
T-38
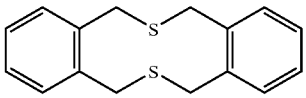
T-39
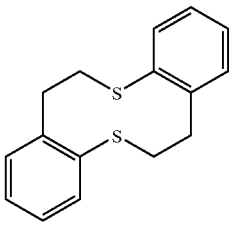
T-40
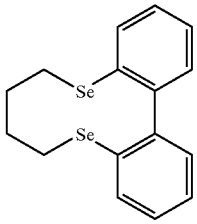
T-41
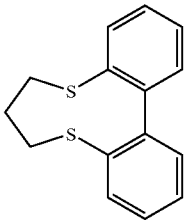
T-42
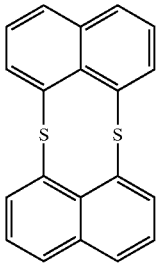
T-43
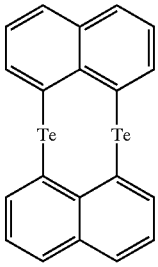
T-44
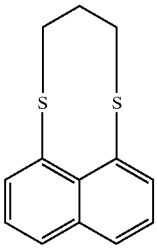
T-45
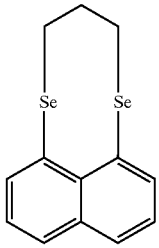
T-46
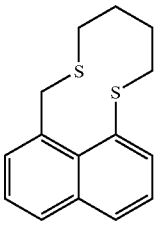
T-47
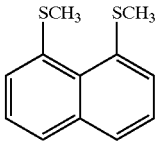
T-48
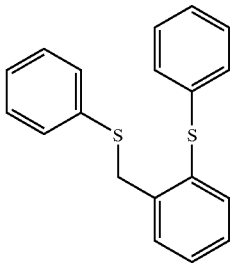
T-49

-continued
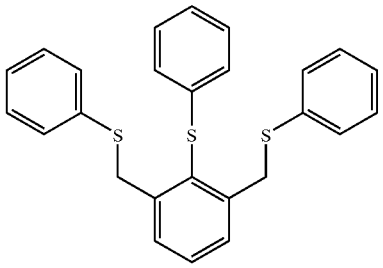
T-50
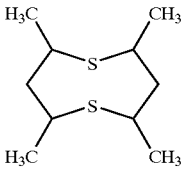
T-51
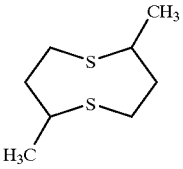
T-52
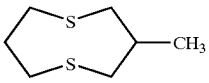
T-53
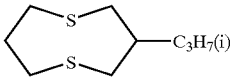
T-54
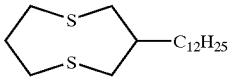
T-55
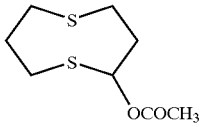
T-56
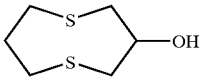
T-57
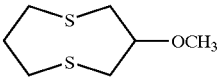
T-58
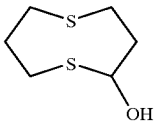
T-59
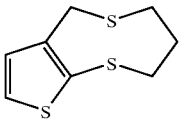
T-60
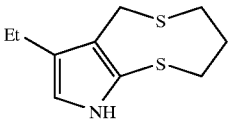
T-61
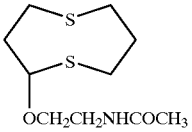
T-62
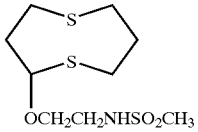
T-63
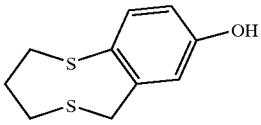
T-64
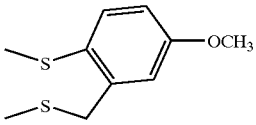
T-65
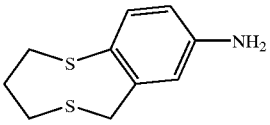
T-66
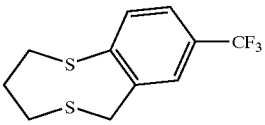
T-67
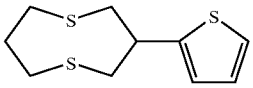
T-68
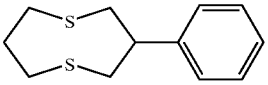
T-69
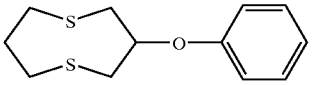
T-70
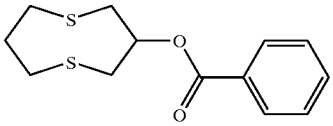
T-71
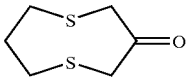
T-72
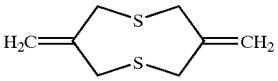
T-73
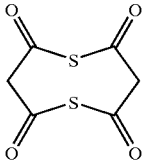
T-74
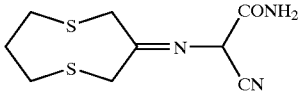
T-75
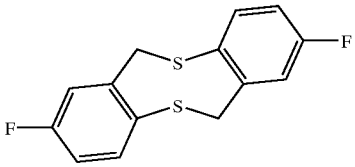
T-76
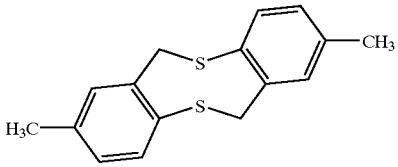
T-77
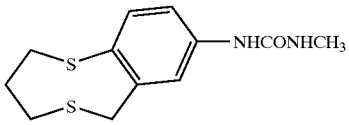
T-78
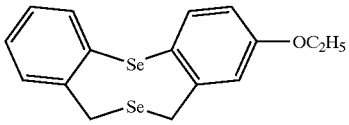
T-79
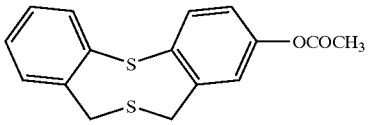
T-80
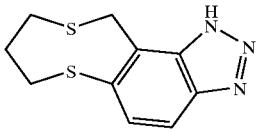
T-81
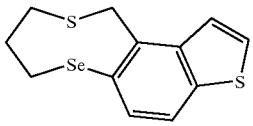
T-82
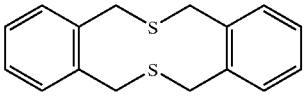
T-83

-continued
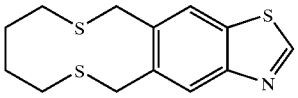
T-84
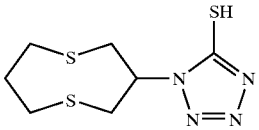
T-85
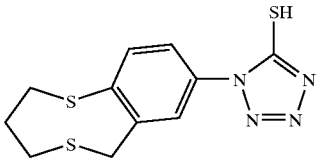
T-86
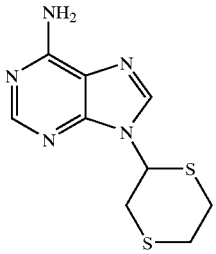
T-87
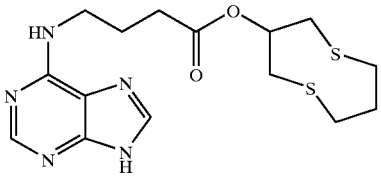
T-88
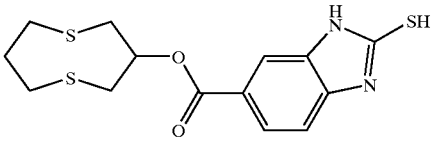
T-89
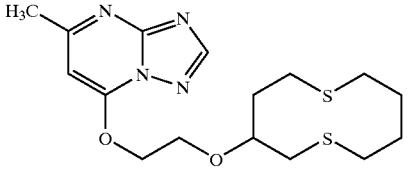
T-90
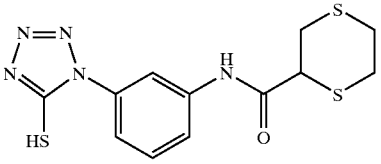
T-91
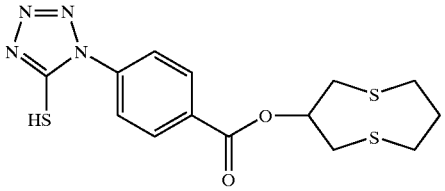
T-92
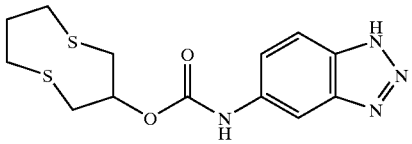
T-93
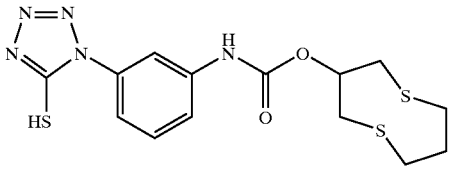
T-94
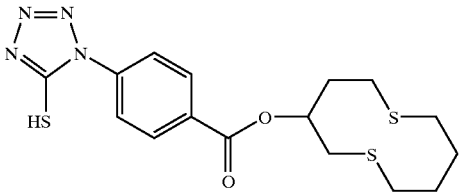
T-95
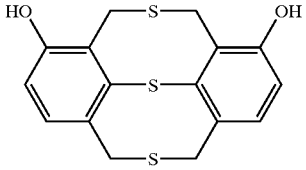
T-96
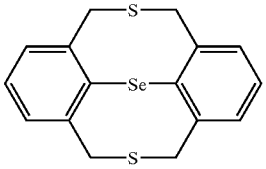
T-97
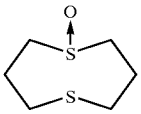
T-98
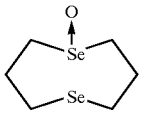
T-99
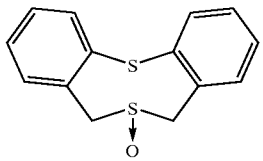
T-100
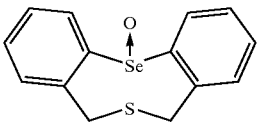
T-101
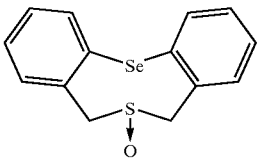
T-102
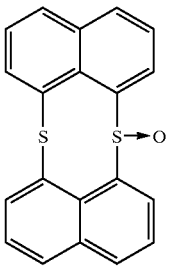
T-103

-continued
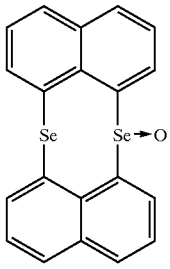
T-104
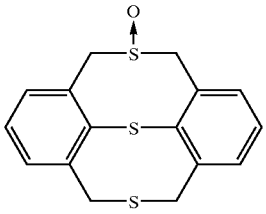
T-105
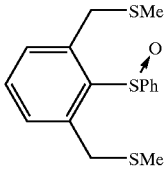
T-106
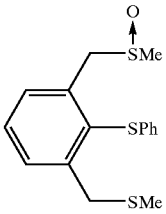
T-107
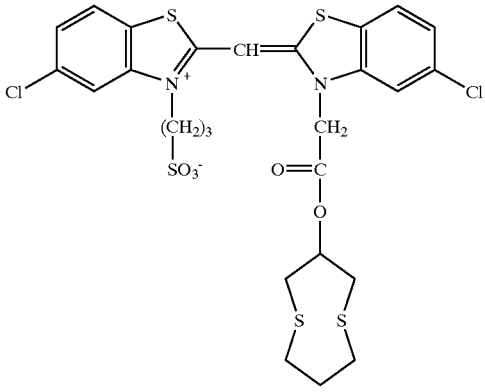
T-108
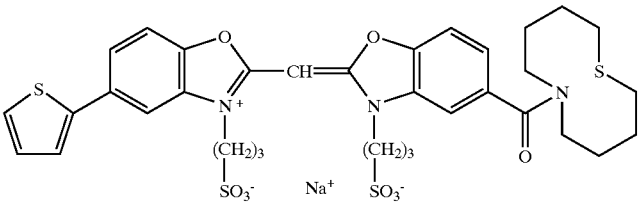
T-109
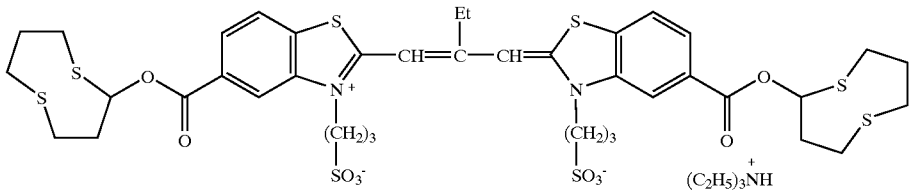
T-110
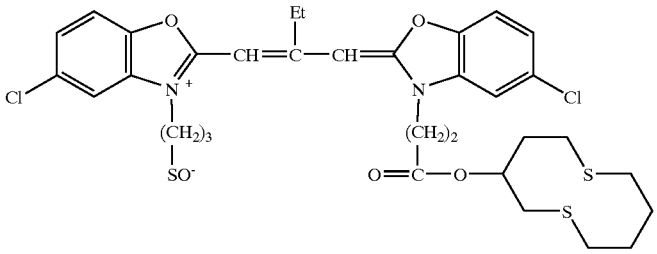
T-111
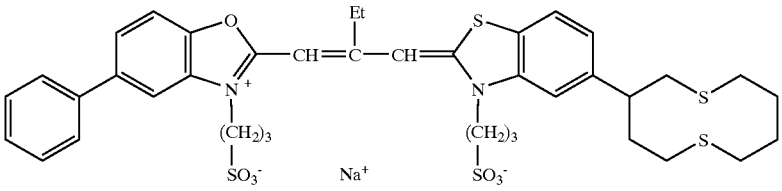
T-112

-continued

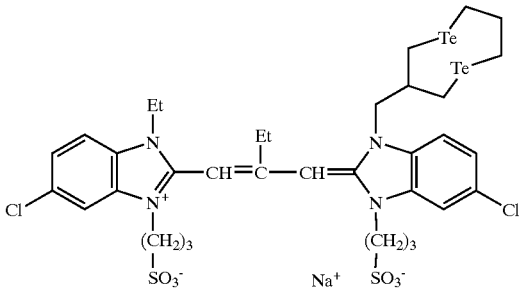

T-113

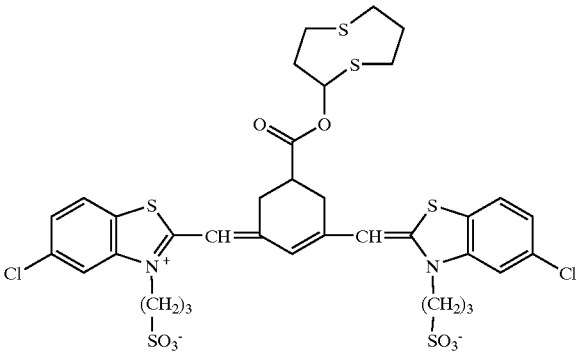

T-114

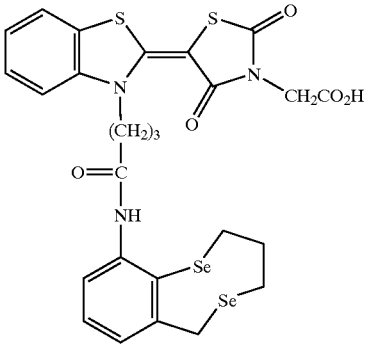

T-115

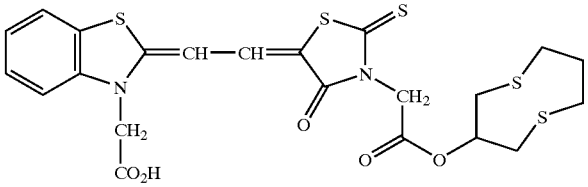

T-116

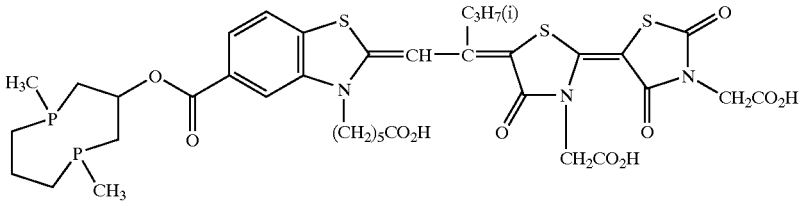

T-117

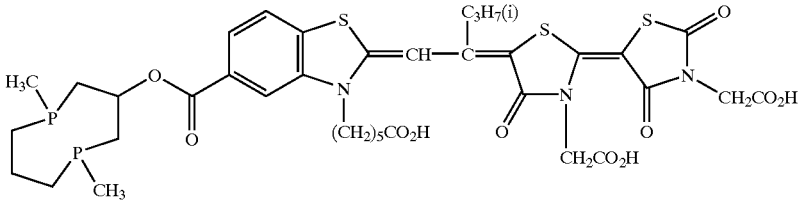

T-117

The sensitizing dyes and the light absorption groups represented by Z of Formula (II) can be synthesized based on the methods described in S. M. Harmer, "Heterocyclic Compounds—Cyanine Dyes and Related Compounds", John Wiley & Sons, New York, London, 1964, D. M. Sturmer, "Heterocyclic Compounds—Special topics in heterocyclic chemistry", Elsevier Science Publication Company Inc., New York, Sec. 18, Item 14, p.p. 482–515, John Wiley & Sons, New York, London, 1977, and "Rodd's Chemistry of Carbon Compounds", $2^{nd}$ ed, vol. IV, Part B, Sec. 15, p.p. 369–422, 1977. The group for adsorbing to silver halide can be synthesized according to the method described in U.S. Pat. No. 5,538,843, from line 37 on page 16 to line 29 on page 17.

The bonding group represented L of Formula (II) is formed by various reactions such as an amide bonding forming reaction and an ester bonding-forming reaction using methods known in the field of organic chemistry. As to such synthesizing reaction, various publications relating to organic chemistry can be referred, for example, "Shin Jikken Kagaku Koza (New Lectures of Experimental Chemistry) No. 14", Synthesis and reaction of organic compounds, vol. I–V, ed. by Nihon Kagaku Kai, Maruzen, Tokyo, 1997, Yoshiro Ogata "Yuuki Hannou Hen (Organic Reaction)", Maruzen, Tokyo, 1962, and L. F. Fieser & M. Fieser "Advanced Organic Chemistry" Maruzen, Tokyo, 1962.

The compounds represented by Formulas (I) or (II) of the invention can be synthesized according to the methods described in J. Org. Chem., 48, 21, 1983, 3707–3712, J. Heterocycle Chemistry, 28, 3, 1991, 573–575, Tetrahedron, 49, 20, 1993, 4355–4364, and Chem. Lett., 12, 1990, 2217–2220.

The compounds represented by Formulas (I) or (II) are preferably used in combination together with another spectral sensitizing dye even though the compounds may be used singly.

SYNTHESIZING EXAMPLE 1

(Synthesis of a Compound Having an Adsorption Group Represented by Formula (II)

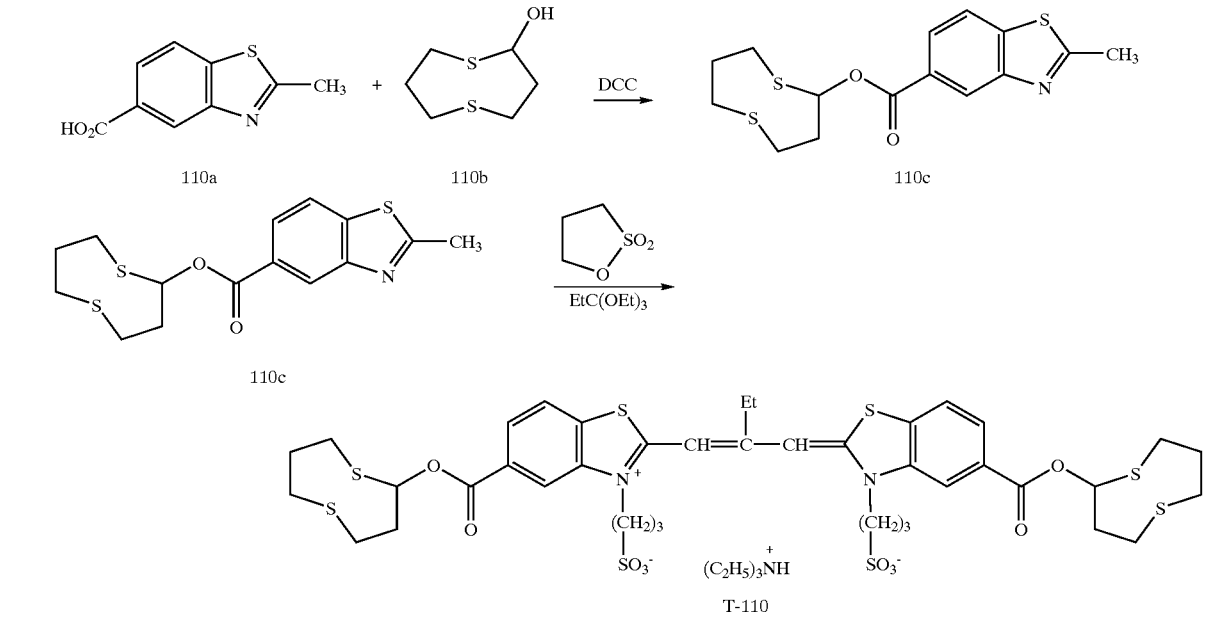

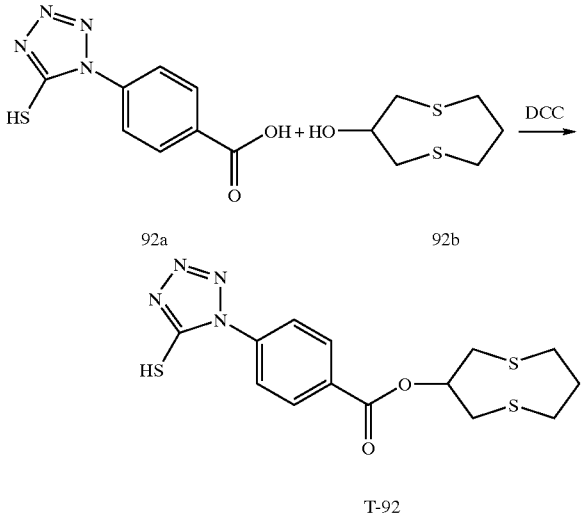

To 100 ml of tetrahydrofuran, 5.0 g of Compound 92a and 4.0 g of Compound 92b were added and then 10 g of 1,3-dichlorohexylcarbodiimide (DCC) was gradually added. After the addition, the reacting liquid was stirred for 2 hours at a room temperature. Then the solvent was removed by a rotary evaporator. The residue was purified by flash chromatography. Thus 3.2 g of a white solid substance was obtained. It was confirmed that the obtained substance was the objective substance T-92 by a mass spectrum and a NMR spectrum.

SYNTHESIZING EXAMPLE 2

(Synthesis of a compound having a light absorption group represented by Formula (II)

To 100 ml of tetrahydrofuran, 5.0 g of Compound 110a and 4.0 g of Compound lob were added and then 10 g of 1,3-dichlorohexylcarbodiimide (DCC) was gradually added. After the addition, the reacting liquid was stirred for 2 hours at the room temperature. Then the solvent was removed by a rotary evaporator. The residue was purified by flash chromatography to obtain 4.1 g of white solid substance. It was confirmed that the purified substance was 110 c by a mass spectrum and a NMR spectrum.

A mixture of 3.0 gram of 110 c and 1.0 g of 3-propanesultone were heated for 1 hour at 130° C., then 20 ml of acetonitrile and 2 ml of triethylamine were added. After dissolution of the contents, 2 g of 1,1,1-triethoxypropane was added, and the mixture was heated while refluxing for 1 hour and cooled by the room temperature. The precipitate was filtered and recrystallized by methanol. Thus a red solid substance was obtained. It was confirmed that the obtained substance was the objective substance T-110 by the mass spectrum and the NMR spectrum.

The silver halide photographic light-sensitive material according to the invention is described in detail below. The compounds represented by Formulas (I) or (II) according to the invention can be used singly or in combination with another sensitizing dye to the silver halide photographic light-sensitive material.

The compound according to the invention, also another sensitizing dye, can be added may be added to the silver halide photographic emulsion at any period in the course of production of the emulsion which is already recognized as the effective period. The compound may be added at any period and process of the production of the silver halide photographic light-sensitive emulsion such as silver halide grain formation and/or before the desalting, during the desalting process and/or during after the desalting and before the start of the chemical sensitization as described in U.S. Pat. Nos. 2,735,766, 3,628,960, 4,183,756 and 4,225,666, JP O.P.I. Publication Nos. 58-184142 and 60-196749, and at the period of just before or during the chemical sensitization and after chemical sensitization until the coating as disclosed in JP O.P.I. Publication No. 58-119320. As disclosed in U.S. Pat. No. 4,225,666 and JP O.P.I. Publication No. 58-7629, the compound may be added singly or in combination with a compound having another structure and may be separately added at the period of during the grain formation process and that of chemical sensitizing process or after the chemical sensitization, or before or during the chemical sensitizing process and after the chemical sensitization, the kind of the compounds and the combination of the compounds to be separately may be changed.

The adding amount of the compound according to the invention may be from $1\times10^{-6}$ to $8\times10^{-3}$ moles per mol of silver halide even though the amount is varied depending on the shape or the size of the silver halide grain. For instance, an amount of from $2\times10^{-6}$ to $3.5\times10^{-3}$ moles per mole of silver halide is preferred, and that of from $7.5\times10^{-6}$ to $1.5\times10^{-3}$ moles per mole of silver halide when the size of the silver halide grain is from 0.2 to 1.3 $\mu$m.

The compound according to the invention may be directly dispersed into the emulsion. The compound may be added to the emulsion in a state of a solution in which the compound is dissolved in a suitable solvent such as methyl alcohol, ethyl alcohol, methyl cellosolve, acetone, water, pyridine and a mixture thereof. An additive such as a base, an acid and a surfactant may exist with the compound at the time of addition. Ultrasonic waves may be applied to dissolve the compound.

The following methods can be applied for adding the methine compound according to the invention: a method by which the compound is dissolved in a volatile organic solvent and thus obtained solution is dispersed in a hydrophilic colloid, and then the dispersion is added to the emulsion such as that described in U.S. Pat. No. 3,469,987; a method by which the compound is dispersed in water and the dispersion is added to the emulsion such as that described in JP O.P.I. Publication No. 46-24185; a method such as that described in U.S. Pat. No. 3,822,135, by which the methine compound is dissolved in a surfactant, and the solution is added to the emulsion; a method such as that described in JP O.P.I. Publication No. 51-74624, by which the methine compound is dissolved using a red-shift compound, and the solution is added to the emulsion; and a method such as that described in JP O.P.I. Publication No. 50-80826, by which the methine compound is dissolved in an acid substantially containing no water, and the solution is added to the emulsion. The methods described in U.S. Pat. Nos. 2,912,343, 3,342,605, 2,996,287, and 3,429,835 can also be applied.

Examples of supersensitizer effectively usable in the spectral sensitization according to the invention include a pyridylamino compound, a triazinylamino compound and an azolium compound described in, for example, U.S. Pat. Nos. 3,511,664, 3,615,613, 3,615,632, 3,615,641, 4,596,767, 4,945,038 and 4,965,182. The using methods of these compounds are preferably those described in these patent publications.

The silver halide usable in the silver halide photographic light-sensitive material according to the invention may be any one of silver bromide, silver iodobromide, silver iodochloride, silver chlorobromide and silver chloride. Preferable silver halide is silver bromide, silver chlorobromide, silver iodochlorobromide and silver halide with high silver chloride content such as that described in JP O.P.I. Publication No. 2-42. The constituent and processing of the light-sensitive material are described below, and the constituent and the processing described in JP O.P.I. Publication No. 2-42 are preferably applied for the silver halide with a high silver chloride content. The constituent and the processing described in JP O.P.I. Publication No. 63-264743 are preferably applied for silver chlorobromide.

The silver halide grain either may have different phases or a uniform phase at the interior and the surface thereof. The silver halide grain may be a silver halide grain in which the latent image is mainly formed on the surface thereof such as a negative type light-sensitive material, a silver halide grain in which the latent image is mainly formed in the interior thereof such as an internal image type light-sensitive material, and a previously fogged grain such as a direct-positive type light-sensitive material. The silver halide grains each having the foregoing various halide compositions, crystal habits, internal grain structures, shapes and distributions are optionally used in the light-sensitive materials or elements for various uses.

The silver halide grain to be used in the silver halide photographic light-sensitive material according to the invention either may be one having a regular crystal shape such as cubic, tetradecahedral and rhombododecahedral or one having an irregular crystal shape such as sphere and planer and one having a combined shape of these crystal shapes. A mixture of grains having various crystal shapes may also be used.

In the silver halide photographic light-sensitive material according to the invention, the aspect ratio of the silver halide grain constituting the silver halide light-sensitive emulsion layer is preferably from 3 to 100. Here, "the aspect ratio is from 3 to 100" means that silver halide grains each having an aspect ratio, a ratio of the circle corresponding diameter to the thickness of the silver halide grain, account for not less than 50% of the projection area of the whole silver halide grains in the emulsion. The aspect ratio is preferably from 3 to 20, more preferably from 4 to 12. The planer grain can easily produced by the method described in Gutoff, "Photographic Science and Engineering", vol. 14, p.p. 248–257, U.S. Pat. Nos. 4,434,226, 4,414,310, 4,433,048 and 4,434,226, and British Patent 2,112,157. The ratio of the presence of the planer grains in the silver halide photographic light-sensitive material according to the invention is preferably not less than 70%, particularly preferably not less than 85%.

The compound according to the invention can be used in various color and black-and-white silver halide photographic light-sensitive materials. In detail, the compound can be used for a color positive light-sensitive material, a color paper light-sensitive material, a color negative light-sensitive material, a color reversal light-sensitive material with or without a color coupler, a direct positive light-sensitive material, a photomechanical light-sensitive material such as a lith film and a duplication lith film, a light-sensitive material for cathode ray tube display recording, a X-ray recording light-sensitive material particularly a light-sensitive material for recording direct photographing using a screen, a light-sensitive material to be used for a silver salt diffusion transfer process, a light-sensitive material to be used in a color diffusion transfer process, a light-sensitive material to be used in a dye transfer process, light-sensitive material in a silver dye bleaching process and a thermally developable light-sensitive material.

The silver halide photographic light-sensitive material to be used in the invention can be produced by a method described in the following publications: P. Grafkides, "Chimie et Physique Photographique", Paul Montel, 1967; C. F. Duffin, "Photographic Emulsion Chemistry", The Focal Press, 1966; and V. L. Zelikman et al., "Making and Coating Photographic Emulsion", The Focal Press, 1964.

Ammonia, potassium thiocyanate, ammonium thiocyanate, a thioether compound such as those described in, for example, U.S. Pat. Nos. 3,271,157, 3,574,628, 3,704,120, 4,297,439 and 4,276,374, a thione compound such as those described in, for example, JP O.P.I. Publication Nos. 53-144319, 53-82408 and 55-77737, and an amine compound such as those described in, for example, JP O.P.I. Publication No. 54-100717, can be used at the period of silver halide grain formation as a silver halide dissolving agent for controlling the growth of the grain. A metal salt such as a cadmium salt, a zinc salt, a thallium salt, an indium salt, an iridium salt and its complex, a rhodium salt and its complex, an iron salt and its complex may coexists in the process of the formation or the physical ripening of the silver halide grain. As the internal image type silver halide photographic light-sensitive emulsion, a conversion type silver halide photographic light-sensitive emulsion, a core/shell type silver halide photographic light-sensitive emulsion and a silver halide photographic light-sensitive emulsion interior of which a different kind metal is contained are cited, which are described in U.S. Pat. Nos. 2,592,250, 3,206,313, 3,447,927, 3,761,276 and 3,935,014.

The silver halide photographic light-sensitive emulsion is usually chemically sensitized. For chemical sensitization, a method described in "Die Grundlagen der Photographischen Prozesse mit Silberhalogeniden", ed. by H. Frieser, p.p. 675–743, Akademische Verlags Gesellschaft, 1968, can be applied. Namely, a sulfur sensitizing method using active gelatin or a compound capable of reacting with silver such as a thiosulfate, a thiourea, a mercapto compound and a rhodanine compound; a selenium sensitizing method; a reducing sensitizing method using a reducing substance such as stannous chloride, an amine, a hydrazine derivative, formamidinesulfonic acid, and a silane compound; and a noble metal sensitizing method in which a noble metal compound such as a gold complex and a complex of a metal of Group VIII of the periodic table such as Pt, Ir and Pd used singly or in combination; can be applied.

Various compounds may be contained in the silver halide photographic light-sensitive material to be used in the invention for preventing fog and stabilizing the photographic property in the course of the producing process, the storage and the photographic processing of the light sensitive material. Namely, various compounds each known as a fog inhibitor or a stabilizer such as the followings can be added: a thiazole such as a benzothiaolium salt described in U.S. Pat. Nos. 3,954,478 and 4,942,721 and JP O.P.I. Publication No. 59-291032, and an open ring substance of thiazole described in Japanese Patent Examined Publication 59-26731; a nitroindazole; a triazole; a benzimidazole particularly a nitro or a halogen substituted substance thereof; a heterocyclic mercapto compound, for example, a mercaptothiazole, a mercaptobenzothiazole, a mercaptobenzimidazole, a mercaptothiadiazole, mercaptotetrazole particularly 1-phenyl-5-mercaptotetrazole and a mercaptopyrimidine; the foregoing heterocyclic mercapto compounds each having a water-soluble group such as a carboxyl group and a sulphonic group; a thioketone compound such as oxazolinethione; an azaindene such as tetraazaindene particularly a hydroxy-substituted (1,3,3a,7)-tetraazaindene; a benzenethiosulfonic acid; a benzenesulfinic acid; and an acetylene compound described in JP O.P.I. Publication No. 62-87957.

A color coupler such as a cyan coupler, a magenta coupler and a yellow coupler and a compound for dispersing the coupler may be contained in the silver halide photographic light-sensitive material according to the invention. Namely, a compound capable of forming color by oxidation coupling with an aromatic primary amine developing agent such as a phenylenediamine derivative and an aminophenol derivative may be contained in the silver halide photographic light-sensitive material. For example, a magenta coupler such as a 5-pyrazolone coupler, a pyrazolobenzimidazole coupler, a cyanoacetylchroman coupler and an open-chain acylacetonitrile coupler; a yellow coupler such as an acylacetoamide coupler, for example, a benzoylacetoanilide and a pivaloylacetoanilide; and a cyan coupler such as a naphthol coupler and a phenol coupler are usable. It is preferred that these couplers are non-diffusible ones each having a hydrophobic group so called as a ballast group in the molecular thereof. The coupler may be either a two-equivalent or four-equivalent coupler to a silver ion. The coupler may be a colored coupler having a color compensation effect or a development inhibitor releasing coupler, so called as a DIR coupler, which release a development inhibitor accompanied with the development. A colorless DIR coupling compound which releases a developing inhibitor and the product of the coupling reaction thereof has no color, may be contained in the silver halide photographic light-sensitive material.

In the silver halide photographic light-sensitive material according to the invention, an additive such as a poly (alkylene oxide) and ether, ester or amine derivative thereof, a thioether compound, a thiomorpholine, a quaternary ammonium chloride, a urethane derivative, a urea derivative, an imidazole derivative and a 3-pyrazolidone may be contained for the purpose of raising the sensitivity or contrast, or accelerating the development. In the silver halide photographic light-sensitive material according to the invention, various dyes may be contained for various purposes such as a filter dye or an anti-irradiation dye. As such dye, for example, the followings may be used: an oxonol dye having a pyrazolone nucleus or a barbituric nucleus described in British Patent Nos. 506,385, 1,177,429, 1,311,884, 1,338,799, 1,385,371, 1,467,214, 1,433,102 and 1,553,516, JP O.P.I. Publication Nos. 48-85130, 49-114420, 52-117123 and 59-111640, JP Examined Publication Nos. 39-22069, 43-13168 and 62-273527, and U.S. Pat. Nos. 3,247,127, 3,469,985 and 4,078,933; another oxonol dye described in U.S. Pat. Nos. 2,533,472 and 3,379,533, British Patent No. 1,278,621, and JP O.P.I. Publication Nos. 1-134447 and 1-183652; an azo dye described in British patent Nos. 575,691, 680, 631, 599, 623, 786, 907, 907,25 and 1,045,609, U.S. Pat. No. 4,255,326, and JP Examined Publication No. 59-211043; an azomethine dye described in British patent Nos. 2,014,598 and 750,031; an anthraquinone dye described in U.S. Pat. No. 2,865,752; an arylidene dye described in U.S. Pat. Nos. 2,533,009, 2,688,541 and 2,538,008, British Patent Nos. 584,609 and 1,210,252, JP O.P.I. Publication Nos. 50-40625, 51-3623, 51-10927 and 54-118247, and JP Examined Publication Nos. 48-3286 and 59-37303; a styryl dye described in JP Examined Publication Nos. 38-3082, 44-16594 and 59-28898; a triarylmethane dye described in British Patent Nos. 446,583 and 1,335,422, and JP O.P.I. Publication No. 59-228250; a merocyanine dye described in British patent Nos. 1,075,653, 1,153,341, 1,284,730, 1,475,228 and 1,542,807; and a cyanine dye described in U.S. Pat. Nos. 2,843,486 and 3,294,539, and JP O.P.I. Publication No. 1-291247.

The following methods can be applied for preventing the diffusion of such dyes. For instance, a method by which a hydrophilic polymer having a charge opposite to that of the dissociated anion dye coexists in the layer as a mordant for fixing the dye in the layer by the interaction between the polymer and the dye is disclosed in U.S. Pat. Nos. 2,548,564, 4,124,386 and 3,625,694. A method for dyeing a specific layer by the use of a water-insoluble solid dye is disclosed in JP O.P.I. Nos. 56-12639, 55-155350, 55-155351,63-27838 and 63-197943, and European Patent No. 15,601. Moreover, a method for dyeing a specific layer by the use of a fine particle of a meta salt on which a dye is absorbed is disclosed in U.S. Pat. Nos. 2,719,088, 2,496,841 and 2,496,843, and JP O.P.I. Publication No. 60-45237.

The silver halide photographic light-sensitive material according to the invention may contain various surfactants for various purposes such as a coating aid, anti-static, sliding ability improvement, anti-adhesion and photographic property improvement such as development acceleration, contrast raising and sensitization. In an embodiment of the invention, another additive may be used together with the silver halide photographic light-sensitive emulsion or another hydrophilic colloid. For example, an anti-fading agent, an inorganic or organic hardener, a color-fog preventing agent, a UV absorbent, a mordant, a plasticizer, a polymer latex and a matting agent are usable. Concrete examples of the additive are described in "Research Disclosure", vol. 176, 1978, XI, D-17643. In the silver halide photographic light-sensitive material according to the invention, a hydrophilic polymer such as gelatin is used.

As the support, for example, baryta paper, resin coated paper, synthesized paper, triacetate film, poly(ethylene terephthalate) film and another plastic base and glass plate are cited.

Light exposure for forming an image can be performed by an ordinary method. Known various light sources such as natural sun light, a tungsten lump, a mercury lump, a xenon arc lump, a carbon arc lump and a flying spot of cathode lay tube are usable. The exposure time of from $1/1{,}000$ to 1 second usually applied by an ordinary camera, and an exposure time less than $1/1{,}000$, for example, from $1/10^4$ to $1/10^6$ seconds by a xenon flush lump or a cathode layer tube are applicable. An exposure time of longer than 1 second may also be applied. The spectral constitution of light to be used for the light exposure can be controlled by the use of a color filter, according to necessity. Laser light can be used for the light exposure. The light exposure may be performed by light irradiated from a fluorescent substance excited by electron lays, X-rays, $\gamma$-rays or $\alpha$-rays. Known methods and processing solutions such as those described in "Research Disclosure" vol. 176, P.P. 28–30, RD-17643, can be applied to the photographic processing of the silver halide photographic light-sensitive material according to the invention. The photographic processing may be a black-and-white processing for forming a silver image or a color photographic processing for forming a dye image. Although the processing temperature is usually selected within the range of from 18° C. to 50° C., a temperature of lower than 18° C or higher than 50° C. may also be applied.

A silver halide photographic light-sensitive material carrying a magnetic record usable in the invention can be produced by the following procedure. A previously thermally treated polyester thin support described in detail in JP O.P.I. Publication Nos. 6-35118 and 6-17528, and Journal of Technical Disclosure No. 94-6023, such as a poly(ethylene aromatic dicarboxylate) type polyester support having a thickness of from 50 to 300 $\mu$m, preferably from 50 to 200 $\mu$m, more preferably from 80 to 115 $\mu$m, particularly preferably from 85 to 105 $\mu$m, is annealed at a temperature from 40° C. to the glass transition point for a time of from 1 to 1,500 hours, and subjected to a surface treatment such as a UV irradiation treatment described in JP Examined Publication Nos. 43-2603, 43-2604 and 45-3828 or a corona treatment described in JP Examined Publication No. 48-5043 and JP O.P.I. Publication No. 51-131576. On such support, a subbing layer described in U.S. Pat. No. 5,326,689 is provided, further an undercoat layer described in U.S. Pat. No. 2,761,791 is provided according to necessity, and then a ferromagnetic described in JP O.P.I. Publication Nos. 59-23505, 4-195726 and 6-59357 is coated thereon. The magnetic layer may have a shape of stripe described in JP O.P.I. Publication Nos. 4-124642 and 4-124645. Further an antistatic treatment is provided and a silver halide photographic light-sensitive emulsion is coated at last. The silver halide photographic light-sensitive emulsion used here is one described in JP O.P.I. Nos. 4-166932, 3-41436 and 3-41437. It is preferable that such silver halide photographic light-sensitive material is produced by a production control method described in JP Examined Publication No. 4-86817 and the production data thereof are recorded in the manner described in JP Examined Publication No. 6-87146. Before or after recording the production data, the coated film is slit to a film having a width of less than that of usual 135 sized according to the method described in JP O.P.I. Publication No. 4-125560. The slit film was perforated to make two perforations per a small image frame so as to match the small format.

Thus produced film is used in a form of packed in a cartridge package described in JP O.P.I. Publication No. 4-157459, a cartridge described in FIG. 9 of Example of JP O.P.I. Publication No. 5-210202, a film container described in U.S. Pat. No. 4,221,479, or a cartridge described in U.S. Pat. Nos. 4,834,306, 4,834,366, 5,226,613, 4,846,418. From the view point of light sealing ability, the film cartridge or the film container is preferably ones capable of enclosing the tongue of the film such as those described in U.S. Pat. Nos. 4,848,693 and 5,317,355. A cartridge having a locking mechanism such as that described in U.S. Pat. No. 5,296,886, a cartridge showing the using condition and having a double exposure preventing function described in U.S. Pat. No. 5,347,334 are preferable. A cartridge described in JP O.P.I. Publication No. 6-85128 in which the film can be charged by only inserting the film may be used.

Thus manufactured film in the cartridge can be subjected to photographing, developing and enjoying various photographic works using the following camera, developing apparatus and other apparatus for laboratory. The function of the film cartridge can be satisfactorily realized when the following camera is used: for example, a easy film loading camera such as that described in JP O.P.I. Publication Nos. 6-8886 and 6-99908; an auto-winding camera such as that described in JP O.P.I. Publication Nos. 6-57398 and 6-101135; a camera by which the kind of film can be changed in the course of photographing such as that described in JP O.P.I. Publication No. 6-205690; a camera by which information as to photographing, such as panorama, high-vision and ordinary format, can be magnetically recorded to the film so that the print aspect ratio can be selected by the recorded information, such as that described in JP O.P.I. Publication Nos. 5-293138 and 5-283382; a camera having a double exposure preventing mechanism such as that described in JP O.P.I. Publication No. 6-101194; and a camera having a film using state displaying function such as that described in JP O.P.I. Publication No. 5-150577.

Thus exposed film may be processed by an auto processing machine described in JP O.P.I. Publication Nos. 6-222514 and 6-222545. The recorded information on the film may be utilized before, in the course of or after the processing according to the description in JP O.P.I. Publication Nos. 6-95265 and 4-123054. The aspect ratio selection function described in JP O.P.I. Publication No. 5-19364 may be utilized. When the processing is carried out by a cine type processing machine, the films are spliced by the method described in JP O.P.I. Publication No. 5-119461. After such treatment, the film information may be converted to the print through a back print and front print to a color paper according to the method described in JP O.P.I. Publication Nos. 2-184835, 4-186335 and 6-79968. The film may be returned to the customer with a return cartridge and an index print described in JP O.P.I. Publication Nos. 5-11353 and 5-232594.

EXAMPLES

The invention is described in detail below referring the examples; however, the invention is not limited thereto.

Example 1

The adding amount of the material to the silver halide photographic light-sensitive material is described in terms of grams per square meter as long as any specific description is not attached. The amounts of the silver halide and the colloidal silver are described in terms of silver, and that of the sensitizing dye is show in terms of moles per mol of silver halide contained in the same layer. Preparation of silver halide photographic light-sensitive emulsion Preparation of Seed Emulsion-1

Seed Emulsion-1 was prepared as follows:

| | |
|---|---|
| Solution A1 | |
| Ossein gelatin | 100 g |
| Potassium bromide | 2.05 g |
| Water to make | 11.5 l |
| Solution B1 | |
| Ossein gelatin | 55 g |
| Potassium bromide | 65 g |
| Potassium iodide | 1.8 g |
| Sulfuric acid of 0.1 moles/l | 38.5 ml |
| Water to make | 2.6 l |
| Solution C1 | |
| Ossein gelatin | 75 g |
| Potassium bromide | 950 g |
| Potassium iodide | 27 g |
| Water to make | 3.0 l |
| Solution D1 | |
| Silver nitrate | 95 g |
| Water to make | 2.7 l |
| Solution E1 | |
| Silver nitrate | 1410 g |
| Water to make | 3.2 l |

To Solution A1 held at 60° C. in a reaction vessel, Solution B1 and Solution D1 were added spending 30 minutes by a controlled double-jet method. Then Solution C1 and Solution E1 were added spending 105 minutes by the controlled double-jet method. The stirring speed was 500 rpm. The solutions were each added in a flow speed so that no nucleus was formed accompanied with the growing of the grain and the expanding of the grain size distribution caused by the Ostwald ripening were not occurred. At the time of the addition of the silver ion solution and the halide ion solution, the pAg was controlled to 8.3±0.05 by a potassium bromide solution and the pH was controlled to 2.0±0.1 by sulfuric acid.

After the addition, the pH was adjusted to 6.0, and then a desalting treatment was applied according to the method described by JP Examined Publication No. 35-16086 to remove excess salts. According to the electron microscopic observation, thus obtained seed emulsion was a cubic shaped tetradecahedral monodisperse emulsion comprising grains having slightly rounded corners with an average diameter of 0.27 $\mu$m and a width of the grain size distribution of 17%.

Preparation of Em-C

A monodisperse core/shell type emulsion was prepared using Seed Emulsion-1 and the following seven solutions.

| | |
|---|---|
| Solution A2 | |
| Ossein gelatin | 10 g |
| Ammonia water (28%) | 28 ml |
| Glacial acetic acid | 3 ml |
| Seed emulsion-1 | equiv. 0.119 moles |
| Water to make | 11.5 l |
| Solution B2 | |
| Ossein gelatin | 0.8 g |
| Potassium bromide | 5 g |
| Potassium iodide | 3 g |
| Water to make | 110 ml |
| Solution C2 | |
| Ossein gelatin | 2.0 g |
| Potassium bromide | 90 g |
| Water to make | 240 ml |
| Solution D2 | |
| Silver nitrate | 9.9 g |
| Ammonia water (28%) | 7.0 ml |
| Water to make | 110 ml |
| Solution E2 | |
| Silver nitrate | 130 g |
| Ammonia water (28%) | 100 ml |
| Water to make | 240 ml |
| Solution F2 | |
| Potassium bromide | 94 g |
| Water to make | 165 ml |
| Solution G2 | |
| Silver nitrate | 9.9 g |
| Ammonia water (28%) | 7.0 ml |
| Water to make | 110 ml |

Solution A2 was held at 60° C. and stirred at 800 rpm by a stirrer. The pH of the Solution A was adjusted to 9.90 by acetic acid. Then Seed Emulsion-1 was dispersed in Solution A2 and Solution $G^2$ was added at a constant flow speed spending for 7 minutes. Thereafter, the pAg was adjusted to 7.3. Further Solution B2 and Solution D2 were simultaneously added spending 20 minutes while holding the pAg at 7.3. After the pH and the pAg of the liquid were each adjusted to 8.83 and 9.0, respectively, using a potassium bromide solution and acetic acid, Solution C2 and Solution E2 were simultaneously added spending 30 minutes.

The flowing speed of the each of the solutions was raised accompanied with the passing of the time so that the ratio of the flowing amount at the initial time to that of the finishing time of the addition was 1:10. The pH was lowered from 8.83 to 8.00 proportionally with the flowing amount ratio. At the time when the ⅔ of each of the whole amounts of Solutions C2 and E2 was added, Solution F2 was additionally poured with a constant speed spending for 8 minutes. The pH was raised from 9.0 to 11.0 at this time. The pH was adjusted to 6.0 using acetic cid.

After the addition, the emulsion was subjected to flocculation desalting treatment using an aqueous solution of Demol, produced by Kao-Atlas Co., Ltd., and an aqueous solution of magnesium sulfate to remove excess salts. Thus an emulsion was obtained which has a pAg of 8.5, pH of 5.85 at 40° C. and an average iodide content of 2.0 mole-%.

According to the electron microscopic observation, thus obtained emulsion was a monodisperse core/shell type emulsion comprising cubic-shaped grains tetradecahedral having slightly rounded corners with an average diameter of 0.55 μm and a width of the grain size distribution of 14%.

Preparation of Seed Emulsion-2

Seed Emulsion-2 was prepared as follows.

| | |
|---|---|
| Solution A3 | |
| Ossein gelatin | 24.2 g |
| Water | 9657 ml |
| Sodium polypropyleneoxy-polyethyleneoxy-disuccinate (10% water-methanol solution) | 6.78 ml |
| Potassium bromide | 10.8 g |
| Nitric acid (10%) | 114 ml |
| Solution B3 | |
| 2.5 moles/l solution of Silver nitrate | 2825 ml |
| Solution C3 | |
| Potassium bromide | 824 g |
| Potassium iodide | 23.5 g |
| Water to make | 2825 ml |
| Solution D3 | |
| 1.75 moles/l solution of Silver nitrate An amount necessary to control silver electrode potential | |

To Solution A3, each 464.3 ml of Solution B3 and Solution C3 were simultaneously added spending 2 minutes at 35° C. while stirring by a mixing stirrer described in JP Examined Publication Nos. 58-58288 and 58-58289 for forming nucleus. After stop of the addition of Solutions B3 and C3, the temperature of Solution A was raised by 60° C. spending 60 minutes and the pH of the solution was adjusted to 5.0 by a 3% aqueous solution of potassium hydroxide. Solution D3 and Solution C3 were further added spending 42 minutes at a flowing speed of 55.4 ml/min. by the double-jet mixing method. The silver electrode potential in the course of the temperature raising from 35° C. to 60° C. and the simultaneously addition of Solutions B3 and C3 were each controlled using Solution D3 so as to be +8 mV and 16 mV, respectively. The silver electrode potential was measured by a silver ion selective electrode and a saturated silver—silver chloride electrode as the comparing electrode.

After the finish of the addition, the pH of thus obtained emulsion was adjusted to 6, and the desalting and washing treatment were applied just after that the pH adjustment.

In thus obtained seed emulsion, hexagonal planer grains having a maximum adjoining side ratio of from 1.0 to 2.0 accounts for not less than 90% of the whole projection area of the silver halide grains. It was confirmed by electron microscopic observation that the average thickness of the hexagonal planer grain was 0.06 μm and the average grain diameter or the circle corresponding diameter was 0.59 μm.

Preparation of Em-D

A planar emulsion was prepared by the use of Seed Emulsion-2 and the following three solutions.

| | |
|---|---|
| Solution A4 | |
| Ossein gelatin | 5.26 g |
| Sodium polypropyleneoxy-polyethyleneoxy-disuccinate (10% water-methanol solution) | 1.4 ml |
| Seed Emulsion-2 | Equiv. 0.094 moles |
| Water to make | 569 ml |
| Solution B4 | |
| Ossein gelatin | 15.5 g |
| Potassium bromide | 114 g |
| Potassium iodide | 3.19 g |
| Water to make | 658 ml |
| Solution C4 | |
| Silver nitrate | 166 g |
| Water to make | 889 ml |

To Solution A4, Solution B4 and Solution C4 were added by the double-jet method spending 107 minutes while vigorously stirring. In the course of the addition, the pH and the pAg were each held at 5.8 and 8.7, respectively. The adding speed of Solutions B4 and C4 were linearly increased so that the speed at the finishing time was become 6.4 times of that at the initial time.

After finish of the addition, a treatment of desalting and washing was applied using Demol, produced by Kao-Atlas Co., Ltd., and an aqueous solution of magnesium sulfate to remove excessive salts. Thus an emulsion having a pAg of 8.5, a pH at 40° C. of 5.85 and an average silver iodide content of 2.0 mole-% was obtained.

According to electron microscopic observation, the emulsion was a planer silver halide grain emulsion in which grains having an average grain diameter of 0.98 μm, a width of grain size distribution of 15% and an average aspect ratio of 4.5 accounted for 82% of the whole projection area of grains. An average of the ratio t/l of the thickness of the planar grain t to the distance between the twin crystal faces 1 was 11. The crystal surface was consisted by (111) face and (100) face and the main surface was all (111) face and the ratio of (111) face to (100) face was 78:22.

The pH and the pAg of these emulsions, Em-C and Em-D, were each adjusted to 5.6 and 7.0, respectively, by acetic acid and sodium chloride. Examples of the emulsion was each chemically ripened most suitably at 60° C. after addition of the compound of the invention as shown in Table 1, ammonium thiocyanate, sodium thiosulfate pentahydrate and chloroauric acid. Then the ripening was stopped by the addition of 1.0 g per mole of silver of 4-hydroxy-6-methyl-1,3,3a,7-tetrazaindene.

Preparation of Silver Halide Photographic Light-Sensitive Material

On the surface of a triacetylcellulose film support, a subbing layer was provided and the following layers were provided on the surface opposite to the subbed surface or the rear surface in the following order from the support.

| | |
|---|---|
| First layer of the rear surface | |
| Alumina sol AS-100 (aluminum oxide, Nissan Kagaku Kogyo Co., Ltd.) | 0.8 g |

-continued

| Second layer of the rear surface | |
|---|---|
| Diacetylcellulose | 100 mg |
| Stearic acid | 10 mg |
| Silica fine particle (Average particle diameter: 0.2 μm) | 50 mg |

On the subbed surface of the triacetylcellulose, the following layers were formed in this order from the support to prepare silver halide photographic light-sensitive materials Nos.101 through 116.

| First layer: Anti-halation layer HC | |
|---|---|
| Black colloidal silver | 0.15 g |
| UV absorbent UV-1 | 0.20 g |
| Dye CC-1 | 0.02 g |
| High-boiling solvent Oil-1 | 0.20 g |
| High-boiling solvent Oil-2 | 0.20 g |
| Gelatin | 1.6 g |
| **Second layer: Interlayer IL-1** | |
| Gelatin | 1.3 g |
| **Third layer: silver halide light-sensitive layer** | |
| Em-C or Em-D | 0.9 g |
| Sensitizing dye | Shown in Table 1 |
| Compound of the invention | Shown in Table 1 |
| Magenta coupler M-2 | 0.30 g |

-continued

| | |
|---|---|
| Magenta Coupler M-3 | 0.13 g |
| Colored magenta coupler CM-1 | 0.04 g |
| DIR compound D-1 | 0.004 g |
| High-boiling solvent Oil-2 | 0.35 g |
| Gelatin | 1.0 g |
| **Forth layer: First protective layer Pro-1** | |
| Silver iodobromide fine grain (average grain diameter: 0.08 μm) | 0.3 g |
| UV absorbent UV-1 | 0.07 g |
| UV absorbent UV-2 | 0.10 g |
| Additive HS-1 | 0.2 g |
| Additive HS-2 | 0.1 g |
| High-boiling solvent Oil-1 | 0.07 g |
| High-boiling solvent Oil-3 | 0.07 g |
| Gelatin | 0.8 g |
| **Fifth layer: Second protective layer Pro-2** | |
| Additive HS-3 | 0.04 g |
| Additive HS-4 | 0.004 g |
| Poly (methyl methacrylate) (average particle diameter: 3 μm) | 0.02 g |
| Copolymer of methyl methacrylate:ethyl methacrylate:methacrylic acid of 3:4:4 | 0.13 g |
| Gelatin | 0.5 g |

In each of the foregoing coated samples, a suitable amount of Surfactants SA-2 and SA-3, a viscosity controlling agent, Hardeners H-2 and H-3, Stabilizers ST-3, ST-4 and ST-5 (one having a weight average molecular weight of 10,000 and one having that of 100,000), Dyes F-4 and F—S and 9.4 mg/M$^2$ of Additive HS-5 were contained.

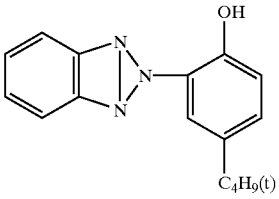

UV-1

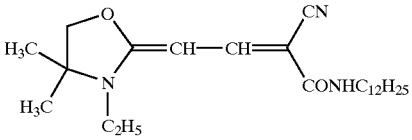

UV-2

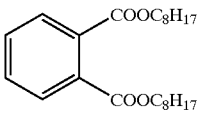

Oil-1

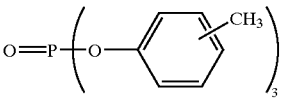

Oil-2

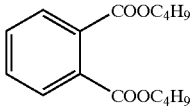

Oil-3

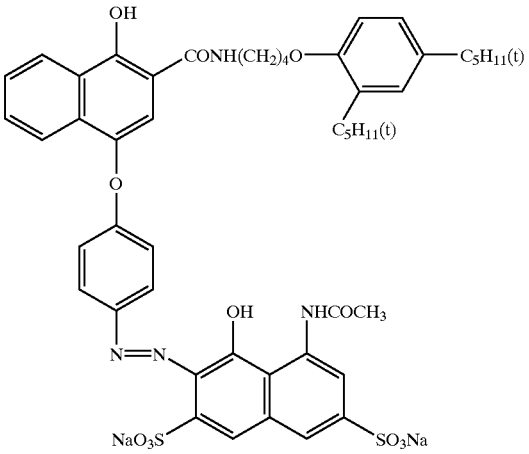

CC-1

-continued
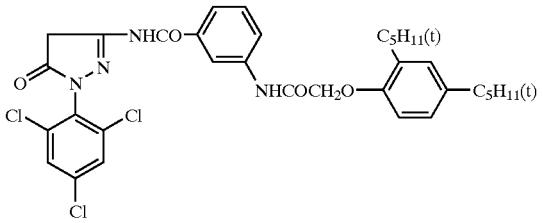
M-2
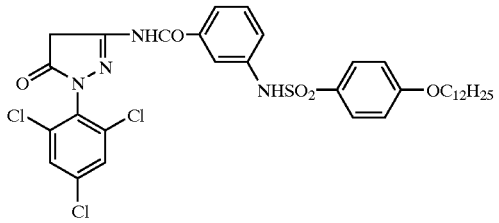
M-3
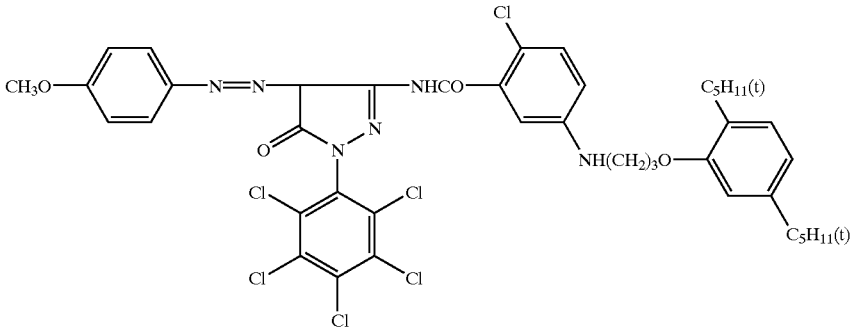
CM-1
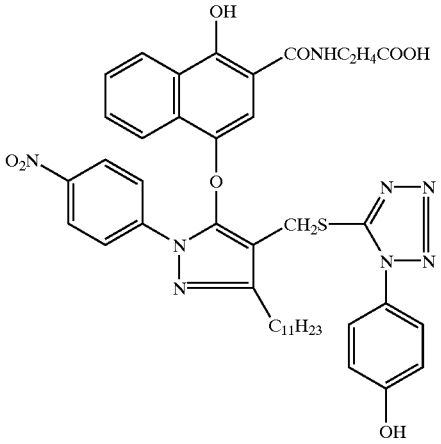
D-1
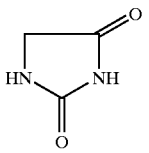
HS-1
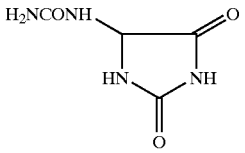
HS-2
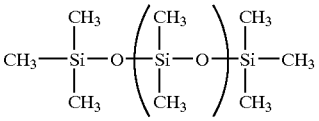
HS-3
Weight average molecular weight = 30,000
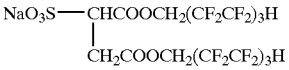
HS-4
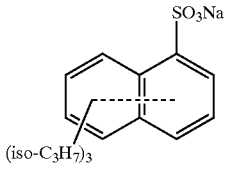
SA-2
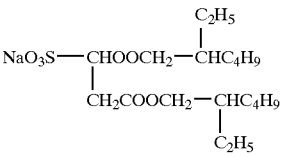
SA-3
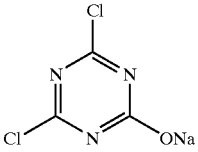
H-2

-continued

H-3

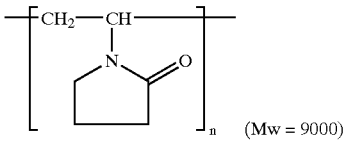

(Mw = 9000)

ST-5

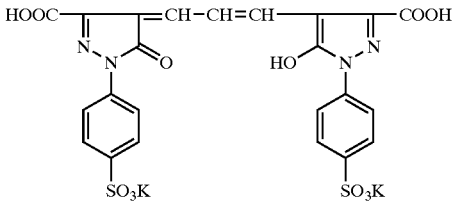

F-5

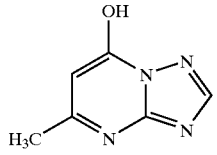

ST-3

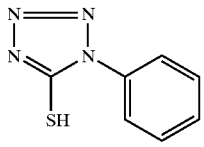

ST-4

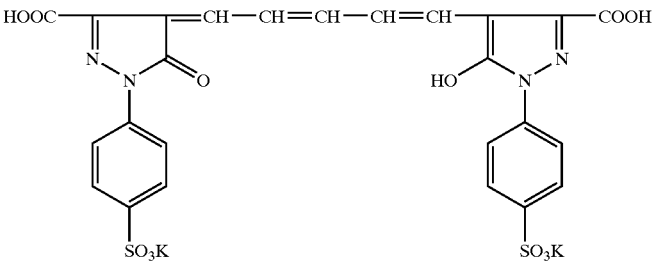

F-4

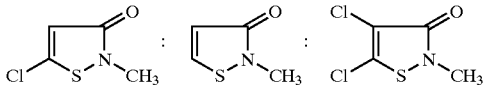

Mole ratio = 50:46:4

HS-5

The prepared samples are each divided to two parts, and a part was not treated and the other part was subjected to an accelerated aging test by standing for 3 days at a relative humidity of 80% and a temperature of 40° C. to evaluate the stability under a high temperature condition.

Thus obtained samples was exposed to white light for 1/100 seconds through an optical wedge and subjected to the developing, bleaching and fixing treatments according to the following processes. The processed samples were subjected to densitometry using an optical densitometer PDA-65, manufactured by Konica Corp. The sensitivity of the sample was calculated as the reciprocal number of the exposure amount at the density point of fog+0.03 and described in terms relative value when the sensitivity of Sample 101 in Table was set as 100. Increasing of fog AF of the sample after the accelerated aging test compared with the sample without accelerated aging and the sensitivity variation of the sample after the accelerated aging $\Delta S=(S1/S2)\times 100\%$ were calculated, in which S1 and S2 were each the sensitivity of the sample before and after the accelerated aging treatment, respectively. Test results are shown in Table 1.

Processing Procedure

| Processing | Treating time | Treating temperature | Supplemental amount* |
|---|---|---|---|
| Color developing | 3 min. 15 sec. | 38 ± 0.3° C. | 780 ml |
| Bleaching | 45 sec. | 38 ± 2.0° C. | 150 ml |
| Fixing | 1 min. 30 sec. | 38 ± 2.0° C. | 830 ml |
| Stabilizing | 60 sec. | 38 ± 5.0° C. | 830 ml |
| Drying | 60 sec. | 55 ± 5.0° C. | — |

*The supplemental amount is a value per $m^2$ of light-sensitive material.

Preparation of Processing Solutions

Composition of Developer

| | |
|---|---|
| Water | 800 ml |
| Potassium carbonate | 30 g |
| Sodium hydrogen carbonate | 2.5 g |
| Potassium sulfite | 3.0 g |
| Sodium bromide | 1.3 g |
| Potassium iodide | 1.2 mg |
| Hydroxylamine sulfate | 2.5 g |
| 4-amino-3-methyl-N-ethyl-N-(β-hydroxyethyl) aniline sulfate | 4.5 g |
| Diethylenetetraminepentaacetic acid | 3.0 g |
| Potassium hydroxide | 1.2 g |

Make up to 1.0 l by water and adjust pH to 10.06 by potassium hydroxide of 20% sulfuric acid.

Composition of Supplemental Solution for the Developer

| | |
|---|---|
| Water | 800 ml |
| Potassium carbonate | 35 g |
| Sodium hydrogen carbonate | 3.0 g |
| Potassium sulfite | 5.0 g |
| Sodium bromide | 0.4 g |
| Hydroxylamine sulfate | 3.1 g |
| 4-amino-3-methyl-N-ethyl-N-(β-hydroxyethyl) aniline sulfate | 6.3 g |
| Diethylenetetraminepentaacetic acid | 3.0 g |
| Potassium hydroxide | 2.0 g |

Make up to 1.0 l by water and adjust pH to 10.18 by potassium hydroxide of 20% sulfuric acid.

Composition of Bleaching Solution

| | |
|---|---|
| Water | 700 ml |
| Ferric (III) ammonium 1,3-diminopropanetetraacetate | 125 g |
| Ethylenediaminetetraacetic acid | 2 g |
| Sodium nitrate | 40 g |
| Ammonium bromide | 150 g |
| Glacial acetic acid | 40 g |

Make up to 1.0 l by water and adjust pH to 4.4 by ammonia water or glacial acetic acid.

Composition of Supplemental Solution for the Bleaching Solution

| | |
|---|---|
| Water | 700 ml |
| Ferric (III) ammonium 1,3-diminopropanetetraacetate | 175 g |
| Ethylenediaminetetraacetic acid | 2 g |
| Sodium nitrate | 50 g |
| Ammonium bromide | 200 g |
| Glacial acetic acid | 56 g |

Make up to 1.0 l by water and adjust pH to 4.0 by ammonia water or glacial acetic acid.

Composition of Fixing Solution

| | |
|---|---|
| Water | 800 ml |
| Ammonium thiocyanate | 120 g |
| Ammonium thiosulfate | 150 g |
| Sodium sulfite | 15 g |
| Ethylenediaminetetraacetic acid | 2 g |

Make up to 1.0 l by water and adjust pH to 6.2 by ammonia water or glacial acetic acid.

Composition of Supplemental Solution for the Fixing Solution

| | |
|---|---|
| Water | 800 ml |
| Ammonium thiocyanate | 150 g |
| Ammonium thiosulfate | 180 g |
| Sodium sulfite | 20 g |
| Ethylenediaminetetraacetic acid | 2 g |

Make up to 1.0 l by water and adjust pH to 6.5 by ammonia water or glacial acetic acid.

Composition of Stabilizing Solution and Supplemental Solution for the Stabilizing Solution

| | |
|---|---|
| Water | 900 ml |
| Adduct of p-octylphenol with 10 moles of ethylene oxide | 2.0 g |
| Dimethylolurea | 0.5 g |
| Hexamethylenetetraamine | 0.2 g |
| 1,2-benzoylthiazoline-3-one | 0.1 g |
| Siloxane L-77, produced by UCC Co., Ltd. | 0.1 g |
| Ammonia water | 0.5 ml |

Make up to 1.0 l by water and adjust pH to 8.5 by ammonia water or 50% sulfuric acid.

TABLE 1

| | | Sensitizing Dye | | Compound of the invention | | | Variation of photographic propertied by aging | | |
|---|---|---|---|---|---|---|---|---|---|
| Sample No. | Silver halide emulsion | Compound | Added amount | Compound | Added amount | Sensitivity S1 | Increasing of fog Δ | Variation of sensitivity ΔS | Remarks |
| 101 | Em-C | Dye5 | *1 | — | — | 100 | 0.08 | 135 | Comp. |
| 102 | Em-D | Dye5 | *2 | — | — | 101 | 0.08 | 128 | Comp. |
| 103 | Em-C | Dye5 | *1 | T-20 | *3 | 110 | 0.04 | 106 | Inv. |
| 104 | Em-D | Dye5 | *2 | T-20 | *3 | 109 | 0.04 | 107 | Inv. |
| 105 | Em-C | Dye5 | *1 | T-57 | *3 | 113 | 0.04 | 107 | Inv. |
| 106 | Em-D | Dye5 | *2 | T-57 | *3 | 112 | 0.03 | 106 | Inv. |
| 107 | Em-C | Dye5 | *1 | T-92 | *1 | 131 | 0.03 | 104 | Inv. |
| 108 | Em-D | Dye5 | *2 | T-92 | *1 | 132 | 0.03 | 102 | Inv. |
| 109 | Em-C | Dye5 | *1 | T-110 | *1 | 120 | 0.04 | 106 | Inv. |
| 110 | Em-D | Dye5 | *2 | T-110 | *1 | 122 | 0.03 | 105 | Inv. |
| 111 | Em-C | — | — | T-110 | *1 | 116 | 0.02 | 103 | Inv. |
| 112 | Em-D | — | — | T-110 | *2 | 118 | 0.03 | 104 | Inv. |
| 113 | Em-C | Dye5 | *1 | T-111 | *1 | 119 | 0.02 | 105 | Inv. |
| 114 | Em-D | Dye5 | *2 | T-111 | *1 | 123 | 0.03 | 105 | Inv. |
| 115 | Em-C | — | — | T-111 | *1 | 115 | 0.02 | 104 | Inv. |
| 116 | Em-D | — | — | T-111 | *2 | 117 | 0.03 | 104 | Inv. |

Comp.: Comparative,
Inv.: Inventive
*1: Added amount was $3.0 \times 10^{-4}$ moles/mol of Ag
*2: Added amount was $5.0 \times 10^{-4}$ moles/mol of Ag
*3: Added amount was $1.0 \times 10^{-2}$ moles/mol of Ag As is cleared in Table 1, the silver halide photographic light-sensitive materials according to the invention have superior properties to the comparative samples in the both states of without and with the accelerated aging. They exhibit high sensitivity and the variation of the fog and the sensitivity caused by the aging are inhibited.

A silver halide photographic light-sensitive material having high sensitivity and excellent storage stability can be obtained by the present invention.

What is claimed is:

1. A silver halide photographic light-sensitive emulsion comprising a silver halide and a compound represented by the following Formula (II):

$$(Z)_{k1}[(L)_{k3}X]_{k2} \qquad \text{(Formula II)},$$

wherein Z represents an organic group capable of adsorbing to the silver halide or an organic group capable of absorbing light; L is a linking group; X is a group having a moiety represented by Formula (I):

Formula (I)

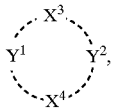

wherein each $X^3$ and $X^4$ represents; each $Y^1$ and $Y^2$ represents independently a group of carbon atoms necessary to complete a 6 to 12 membered heterocyclic ring with $X^3$ and $X^4$; k1 represents an integer of 1 to 4; k2 represents an integer of 1 to 4; and k3 represents an integer of 0 or 1.

2. The silver halide photographic light-sensitive emulsion of claim 1, wherein the silver halide emulsion further comprises a spectral sensitizing dye.

3. The silver halide photographic light-sensitive emulsion of claim 2, wherein the spectral sensitizing dye is a cyanine dye or a merocyanine dye.

4. A silver halide photographic light-sensitive material comprising a support having thereon a photosensitive layer comprising the photosensitive silver halide emulsion of claim 1.

5. A silver halide photographic light-sensitive material comprising a support having thereon a photosensitive layer comprising the photosensitive silver halide emulsion of claim 2.

6. A silver halide photographic light-sensitive material comprising a support having thereon a photosensitive layer comprising the photosensitive silver halide emulsion of claim 3.

* * * * *